US010590757B1

(12) United States Patent
Miller et al.

(10) Patent No.: US 10,590,757 B1
(45) Date of Patent: Mar. 17, 2020

(54) MEASUREMENT WHILE DRILLING COMMUNICATION SCHEME

(71) Applicant: Erdos Miller, Inc., Houston, TX (US)

(72) Inventors: Kenneth C. Miller, Houston, TX (US); David Erdos, Houston, TX (US); Abraham C. Erdos, Houston, TX (US)

(73) Assignee: Erdos Miller, Inc., Houston, TX (US)

( * ) Notice: Subject to any disclaimer, the term of this patent is extended or adjusted under 35 U.S.C. 154(b) by 0 days.

(21) Appl. No.: 16/379,584

(22) Filed: Apr. 9, 2019

(51) Int. Cl.

| | |
|---|---|
| ***E21B 44/00*** | (2006.01) |
| ***E21B 47/024*** | (2006.01) |
| ***E21B 47/12*** | (2012.01) |
| *E21B 7/04* | (2006.01) |
| *E21B 47/16* | (2006.01) |
| *E21B 47/18* | (2012.01) |

(52) U.S. Cl.
CPC ..... *E21B 47/024* (2013.01); *E21B 47/12* (2013.01); *E21B 7/04* (2013.01); *E21B 47/16* (2013.01); *E21B 47/18* (2013.01)

(58) Field of Classification Search
CPC ..... E21B 47/024; E21B 47/12; E21B 7/04; E21B 47/19
See application file for complete search history.

(56) References Cited

U.S. PATENT DOCUMENTS

| | | | |
|---|---|---|---|
| 5,230,387 | A | 7/1993 | Waters et al. |
| 5,246,273 | A | 9/1993 | Rosar |
| 5,548,397 | A | 8/1996 | Kool et al. |
| 6,161,630 | A | 12/2000 | Stump et al. |
| 7,703,548 | B2 | 4/2010 | Clark |
| 7,957,946 | B2 | 6/2011 | Pirovolou |
| 9,129,236 | B2 | 9/2015 | Elinas et al. |
| 9,157,279 | B2 | 10/2015 | Schumacher et al. |
| 9,593,567 | B2 | 3/2017 | Pink et al. |
| 9,772,608 | B2 | 9/2017 | Spacek |
| 2003/0076107 | A1 | 4/2003 | Fanini et al. |
| 2006/0185899 | A1 | 8/2006 | Alft et al. |
| 2009/0000823 | A1 | 1/2009 | Pirovolou |
| 2010/0163306 | A1 | 7/2010 | Pabon et al. |
| 2012/0024606 | A1 | 2/2012 | Pirovolou et al. |

(Continued)

FOREIGN PATENT DOCUMENTS

| | | | |
|---|---|---|---|
| EP | 1903178 | B1 | 3/2008 |
| WO | 0028188 | A1 | 5/2000 |
| WO | 2006007017 | A1 | 1/2006 |

*Primary Examiner* — Mohamed Charioui
*Assistant Examiner* — Christine Y Liao
(74) *Attorney, Agent, or Firm* — Faegre Drinker Biddle & Reath LLP

(57) ABSTRACT

A measurement while drilling system including a first module and a second module. The first module situated at a distal end of a drill string and including a downhole processor configured to determine that the drill string is one of on a drill plan and off the drill plan, and a downhole communication module communicatively coupled to the downhole processor to transmit signals. The second module situated at a proximal end of the drill string and including an uphole communication module configured to receive the signals. Where the downhole processor is configured to transmit non-compressed data if the drill string is off the drill plan and compressed data if the drill string is on the drill plan.

20 Claims, 8 Drawing Sheets

(56) References Cited

U.S. PATENT DOCUMENTS

| | | | | |
|---|---|---|---|---|
| 2013/0135114 | A1* | 5/2013 | Ringer | E21B 47/12 340/855.7 |
| 2015/0134390 | A1 | 5/2015 | Hildebrand et al. | |
| 2015/0218888 | A1 | 8/2015 | Schonberger et al. | |
| 2017/0089195 | A1* | 3/2017 | Yu | E21B 47/18 |
| 2018/0267199 | A1* | 9/2018 | Xu | E21B 47/0002 |
| 2019/0085683 | A1* | 3/2019 | Gillan | E21B 47/024 |

* cited by examiner

MEASUREMENT WHILE DRILLING COMMUNICATION SCHEME

TECHNICAL FIELD

The present disclosure relates to measurement while drilling (MWD) systems. More specifically, the disclosure relates to communicating information from the drill string in the well borehole to the surface.

BACKGROUND

Drilling systems can be used for drilling well boreholes in the earth for extracting fluids, such as oil, water, and gas. The drilling systems include a drill string for boring the well borehole into a formation that contains the fluid to be extracted. The drill string includes tubing or a drill pipe, such as a pipe made-up of jointed sections, and a drilling assembly attached to the distal end of the drill string. The drilling assembly includes a drill bit at the distal end of the drilling assembly. Typically, the drill string, including the drill bit, is rotated to drill the well borehole. Often, the drilling assembly includes a mud motor that rotates the drill bit for boring the well borehole.

Obtaining downhole measurements during drilling operations is known as MWD or logging while drilling (LWD). Some downhole measurements, referred to as surveys, include information about the location, such as the orientation and/or position, of the drill string in the well borehole. This survey data is gathered by the drill string in the borehole, such as by an MWD system in the drill string and communicated to the surface. Transmitting survey data can be a time-consuming process that reduces the timeliness of the data and increases the time it takes to drill a well, which leads to inaccurate information about the position of the drill string and an increase in the cost of drilling the well.

SUMMARY

In an Example 1, a measurement while drilling system including a first module and a second module. The first module situated at a distal end of a drill string and including a downhole processor configured to determine that the drill string is one of on a drill plan and off the drill plan, and a downhole communication module communicatively coupled to the downhole processor to transmit signals. The second module situated at a proximal end of the drill string and including an uphole communication module configured to receive the signals. Where the downhole processor is configured to transmit non-compressed data if the drill string is off the drill plan and compressed data if the drill string is on the drill plan.

In an Example 2, the measurement while drilling system of Example 1, wherein the downhole processor is configured to determine if an orientation of the drill string is one of on the drill plan and off the drill plan.

In an Example 3, the measurement while drilling system of Example 1, wherein the downhole processor is configured to determine if a position of the drill string in a borehole is one of on the drill plan and off the drill plan.

In an Example 4, the measurement while drilling system of Example 1, wherein the downhole processor is configured to obtain at least one of a six-axis survey and a calculated survey of the drill string to determine that the drill string is one of on the drill plan and off the drill plan.

In an Example 5, the measurement while drilling system of Example 1, wherein the downhole processor is configured to transmit delta compressed signals between surveys of the drill string.

In an Example 6, the measurement while drilling system of Example 1, wherein the downhole processor is at least one of pre-programmed with the drill plan and configured to receive drill plan information.

In an Example 7, the measurement while drilling system of Example 1, wherein the compressed data includes compressed delta data.

In an Example 8, the measurement while drilling system of Example 1, wherein the downhole processor is configured to transmit at least one bit that indicates that the drill string is on the drill plan or off the drill plan.

In an Example 9, the measurement while drilling system of Example 1, wherein the downhole processor is configured to obtain at least one survey value of the drill string and compare the at least one survey value to at least one threshold value to determine that the drill string is one of on the drill plan and off the drill plan.

In an Example 10, the measurement while drilling system of Example 1, wherein the downhole processor is configured to transmit the signals based on at least one of time between transmissions and distance drilled and/or the downhole processor is configured to transmit at least one of survey data, sliding data, and rotating data.

In an Example 11, a measurement while drilling system including a first module and a second module. The first module situated at a distal end of a drill string and including a downhole processor and a downhole communication module communicatively coupled to the downhole processor and configured to transmit data from the downhole processor. The second module situated at a proximal end of the drill string and including an uphole communication module configured to receive the data transmitted by the downhole communication module. Wherein the downhole processor is configured to determine which well segment of a drill plan the drill string is in based on an orientation of the drill string and to transmit compressed data that corresponds to the well segment of the drill plan that the drill string is determined to be in.

In an Example 12, the measurement while drilling system of Example 11, wherein the drill plan includes three well segments.

In an Example 13, the measurement while drilling system of Example 11, wherein the downhole processor is configured to obtain at least one of a six-axis survey and a calculated survey of the drill string to determine which well segment of the drill plan the drill string is in.

In an Example 14, a method of controlling well path trajectory including determining, by a downhole processor, that the drill string is one of on a drill plan and off the drill plan; transmitting, by the downhole processor, non-compressed data if the drill string is off the drill plan and compressed data if the drill string is on the drill plan; and receiving, by an uphole processor, the non-compressed data and the compressed data.

In an Example 15, the method of Example 14, including obtaining, by the downhole processor, at least one of a six-axis survey and a calculated survey of the drill string to determine that the drill string is one of on the drill plan and off the drill plan.

In an Example 16, the method of Example 14, including transmitting delta compressed signals between surveys of the drill string.

In an Example 17, the method of Example 14, including transmitting at least one bit that indicates that the drill string is one of on the drill plan and off the drill plan.

In an Example 18, the method of Example 14, including obtaining at least one orientation value, and comparing the at least one orientation value to one or more threshold values to determine that the drill string is in a well segment of a well plan and to determine that the drill string is one of on the drill plan and off the drill plan.

In an Example 19, the method of Example 14, wherein determining, by the downhole processor, that the drill string is one of on the drill plan and off the drill plan comprises receiving, by the downhole processor, at least one of well string length and drill plan information.

In an Example 20, the method of Example 14, wherein determining, by the downhole processor, that the drill string is one of on the drill plan and off the drill plan comprises comparing, by the downhole processor, an inclination value to an inclination threshold value While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

Figure 1:
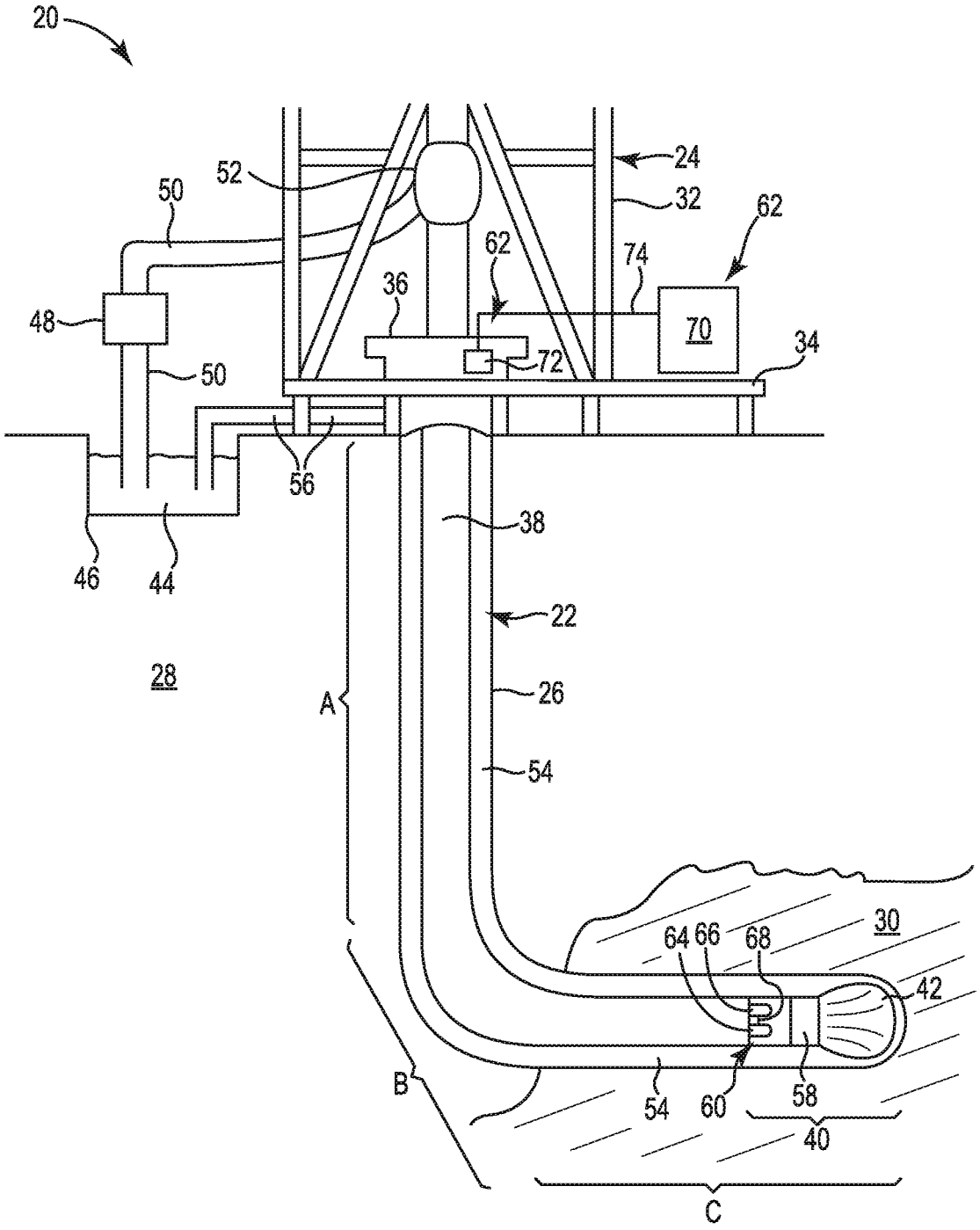
FIG. 1 is a diagram illustrating a MWD system configured to communicate well path trajectory information from a drill string to the surface, according to embodiments of the disclosure.

While the disclosure is amenable to various modifications and alternative forms, specific embodiments have been shown by way of example in the drawings and are described in detail below. The intention, however, is not to limit the disclosure to the embodiments described. On the contrary, the disclosure is intended to cover all modifications, equivalents, and alternatives falling within the scope of the disclosure as defined by the appended claims.

DETAILED DESCRIPTION

FIG. 1 is a diagram illustrating a MWD system 20 configured to communicate information from a drill string 22 to the surface, according to embodiments of the disclosure. The information communicated from the drill string 22 to the surface includes well path trajectory information. Also, in embodiments, the information communicated from the drill string 22 to the surface includes other information, such as gamma radiation measurements, temperature, pressure, and rotation rate (RPM).

The system 20 includes the drill string 22 and a rig 24 for drilling a well borehole 26 through earth 28 and into a formation 30. After the well borehole 26 has been drilled, fluids such as water, oil, and gas can be extracted from the formation 30. In embodiments, the rig 24 is situated on a platform that is on or above water for drilling into the ocean floor.

The rig 24 includes a derrick 32, a derrick floor 34, a rotary table 36, and the drill string 22. The drill string 22 includes a drill pipe 38 and a drilling assembly 40 attached to the distal end of the drill pipe 38 at the distal end of the drill string 22. The drilling assembly 40 includes a drill bit 42 at the bottom of the drilling assembly 40 for drilling the well borehole 26.

A fluidic medium, such as drilling mud 44, is used by the system for drilling the well borehole 26. The fluidic medium circulates through the drill string 22 and back to the fluidic medium source, which is usually at the surface. In embodiments, drilling mud 44 is drawn from a mud pit 46 and circulated by a mud pump 48 through a mud supply line 50 and into a swivel 52. The drilling mud 44 flows down through an axial central bore in the drill string 22 and through jets (not shown) in the lower face of the drill bit 42. Borehole fluid 54, which contains drilling mud 44, formation cuttings, and formation fluid, flows back up through the annular space between the outer surface of the drill string 22 and the inner surface of the well borehole 26 to be returned to the mud pit 46 through a mud return line 56. A filter (not shown) can be used to separate formation cuttings from the drilling mud 44 before the drilling mud 44 is returned to the mud pit 46. In embodiments, the drill string 22 has a downhole drill motor 58, such as a mud motor, for rotating the drill bit 42.

To drill the well borehole 26, drilling personnel devise a drill plan that the drill string 22 is directed to follow or otherwise configured to follow. In embodiments, drilling personnel develop the drill plan prior to beginning drilling operations. In embodiments, the drilling personnel can revise the drill plan during drilling operations.

The drill plan includes one or more well segments that define the contours of the finished well borehole 26. In example embodiments, the drill plan includes a first vertical well segment A, a second curved well segment B, and a third horizontal or lateral well segment C. In some embodiments, the drill plan includes only one or two well segments, such as only a vertical well segment, or only a vertical well segment and an angled well segment. In some embodiments, the drill plan includes more than three segments.

To direct the drill string 22 and/or to maintain the drill string 22 on the drill plan, the system 20 takes surveys that indicate the location, such as the orientation and/or the position, of the drill string 22, such as the distal end of the drill sting 22, in the well borehole 26. In some embodiments, the system 20 determines specifically where the drill string 22 is in the well path and compares this location to the drill plan to determine if the drill string 22 is on the drill plan or off the drill plan. In some embodiments, the system 20 determines which well segment the drill string 22 is in to determine if the drill string 22 is on the drill plan or off the drill plan.

In embodiments, the system 20 compares survey data to the drill plan and determines whether the drill string 22 is on the drill plan or off the drill plan. In embodiments, the drill string 22 is on the drill plan if the survey data of the drill string 22 is within some tolerance of the planned trajectory of the drill plan. In embodiments, the drill string 22 is off the drill plan if the survey data of the drill string 22 is outside the tolerance of the planned trajectory of the drill plan. In some embodiments, the drill string 22 is on the drill plan if the well path and/or the quality control metrics, such as total gravity, total magnetic field, an/or dip angle measurements, are within the expected tolerance of the drill plan. In some embodiments, the drill string 22 is off the drill plan if the well path and/or the quality control metrics, such as total gravity, total magnetic field, an/or dip angle measurements, are outside the expected tolerance of the drill plan.

If the drill string 22 is on the drill plan, the system 20 transmits compressed survey signals or data from the drill string 22 to the surface, and if the drill string is off the drill plan, the system 20 transmits non-compressed survey signals or data from the drill string 22 to the surface. The compressed survey signals include a smaller amount of data than the non-compressed survey signals, such that if the drill string 22 is on the drill plan a smaller amount of data is transmitted from the drill string 22 in the well borehole 26 to the surface. This requires a smaller amount of time and provides more reliable information about the orientation and/or position of the drill string 22 in the well borehole 26. In embodiments, if the drill string is off the drill plan, the system 20 transmits an error flag or another indication that indicates the drill string 22 is off the drill plan.

The compressed and non-compressed data transmitted by the systems and methods described herein can be another suitable data, including data other than survey data. In some embodiments, the compressed and non-compressed data transmitted by the systems and methods described herein is sliding data obtained while sliding, i.e., while holding the drill string 22 stationary and rotating only the drill bit 42 using a fluidic medium, such as drilling mud 44. In some embodiments, the compressed and non-compressed data transmitted by the systems and methods described herein is rotating data obtained while rotating the drill string 22.

The system 20, in the drilling assembly 40, includes a first module 60 at the distal end of the drill pipe 38 and the distal end of the drill string 22, and a second module 62 at the surface and the proximal end of the drill string 22. In embodiments, the second module 62 is attached to the drill rig 24.

The first module 60 includes a downhole processor 64 and a downhole communication module 66 communicatively coupled, such as electrically coupled by wire 68 or wirelessly coupled, to the downhole processor 64 to transmit signals. In embodiments, the downhole communication module 66 includes a pulser, such as a mud pulse valve, that is configured to provide a pressure pulse in the fluidic medium in the drill string 22, such as in the drilling mud 44.

The second module 62 includes an uphole processor 70 and an uphole communication module 72 communicatively coupled, such as electrically coupled by wire 74 or wirelessly coupled, to the uphole processor 70 and configured to receive the signals from the downhole communication module 66. In embodiments, the uphole communication module 72 includes a pressure sensor. In embodiments, the pressure pulse is an acoustic signal.

In embodiments, the downhole communication module 66 is configured to provide an acoustic signal, such as one or more pulses, that is transmitted to the surface through one or more transmission medium or pathways. The pathways can include through the fluidic medium in the drill string 22, through the material (such as metal) that the pipe is made of, and through one or more other separate pipes or pieces of material that accompany the drill string 22, where the acoustic signal can be transmitted through the passageway of the separate pipe or through the material of the separate pipe or piece of material that accompanies the drill string 22. In embodiments, the second module 62 includes the uphole processor 70 and an acoustic signal sensor configured to receive the acoustic signal and communicatively coupled, such as electrically coupled by wire or wirelessly coupled, to the uphole processor 70.

In embodiments, each of the downhole processor 64 and the uphole processor 70 is a computing machine that includes memory that stores executable code that can be executed by the computing machine to perform the processes and functions described in this disclosure. In embodiments, the computing machine is one or more of a computer, a microprocessor, and a micro-controller, or the computing machine includes multiples of a computer, a microprocessor, and a micro-controller. In embodiments, the memory is one or more of volatile memory, such as random access memory (RAM), and non-volatile memory, such as flash memory, battery-backed RAM, read only memory (ROM), varieties of programmable read only memory (PROM), and disk storage. Also, in embodiments, each of the first module 60 and the second module 62 includes one or more power supplies for providing power to the module.

In operation, the downhole processor 64 is configured to determine that the drill string 22 is one of on the drill plan and off the drill plan, and the downhole processor 64 is configured to transmit non-compressed survey signals if the drill string 22 is off the drill plan and compressed survey signals if the drill string 22 is on the drill plan. The downhole processor 64 transmits the compressed and non-compressed survey signals via the downhole communication module 66 and the uphole communication module 72 receives the signals and communicates the received signals to the uphole processor 70.

Figure 2:
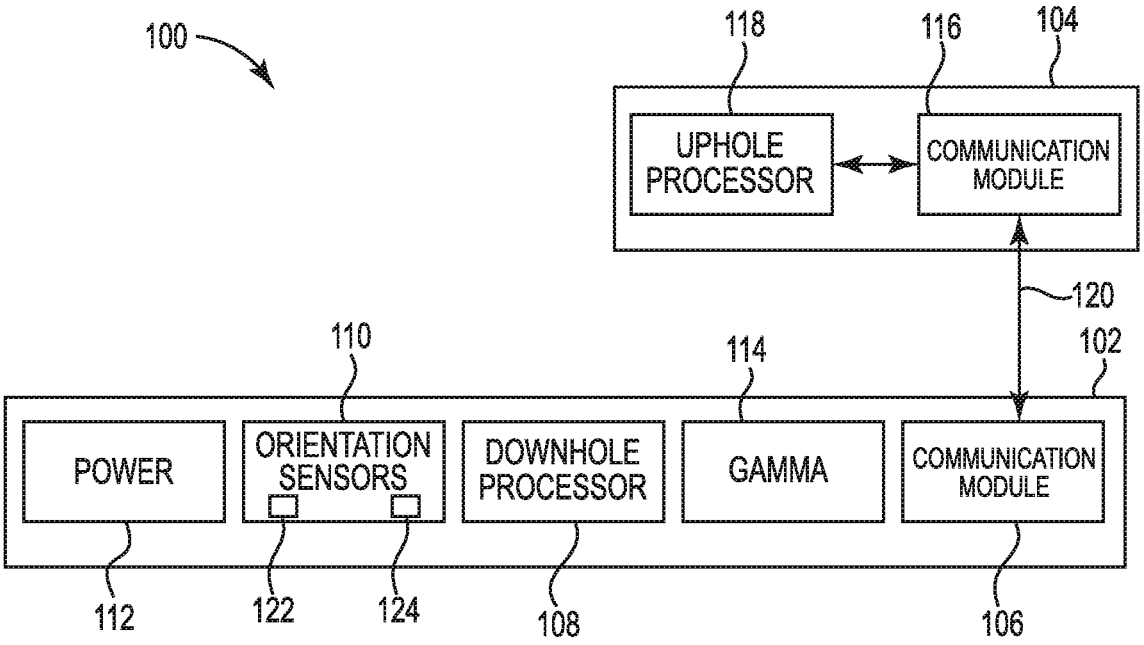
FIG. 2 is a diagram illustrating a MWD system configured to determine that the trajectory of a drill string is either on a drill plan or off the drill plan, and to transmit non-compressed survey signals if the drill string is off the drill plan and compressed survey signals if the drill string is on the drill plan, according to embodiments of the disclosure.

FIG. 2 is a diagram illustrating a MWD system 100 configured to determine that the trajectory of a drill string, such as drill string 22, is either on a drill plan or off the drill plan, and to transmit non-compressed survey signals if the drill string is off the drill plan and compressed survey signals if the drill string is on the drill plan, according to embodiments of the disclosure. The MWD system 100 includes a first module 102 that is a downhole module and a second module 104 that is an uphole module. In embodiments, the MWD system 100 is similar to the MWD system 20 of FIG. 1. In embodiments, the first module 102 is similar to the first module 60 (shown in FIG. 1). In embodiments, the second module 104 is similar to the second module 62 (shown in FIG. 1).

The first module 102 is situated at the distal end of the drill pipe, such as drill pipe 38, and at the distal end of the drill string, such as drill string 22, and the second module 104 is situated at the proximal end of the drill string, such as drill string 22, and/or on the surface. In embodiments, the first module 102 is securely attached to the drill pipe. In embodiments, the first module 102 is rotatably attached to the drill pipe. In embodiments, the second module 104 is attached to the drill rig, such as drill rig 24. In embodiments, the second module 104 is securely attached to the drill rig. In embodiments, the second module 104 is rotatably attached to the drill rig.

The first module 102 includes a downhole communication module 106, a downhole processor 108, orientation sensors 110, and a power module 112. In embodiments, the downhole processor 108 is similar to the downhole processor 64 (shown in FIG. 1). In embodiments, the downhole communication module 106 is similar to the downhole communication module 66 (shown in FIG. 1).

The downhole processor 108 is communicatively coupled to the communication module 106 and to the orientation sensors 110. In embodiments, the downhole processor 108 is communicatively coupled to the communication module 106 via conductive paths or wires. In embodiments, the downhole processor 108 is wirelessly coupled to the communication module 106. In embodiments, the downhole processor 108 is communicatively coupled to the orientation sensors 110 via conductive paths or wires. In embodiments, the downhole processor 108 is wirelessly coupled to the orientation sensors 110.

The power module 112 is conductively coupled to the communication module 106, the downhole processor 108, and the orientation sensors 110 to provide power to each of these devices. In embodiments, the power module 112 includes one or more batteries. In embodiments, the power module 112 is controlled by the downhole processor 108 to save energy and/or conserve battery power.

Optionally, the first module 102 includes a gamma radiation module 114 that includes one or more gamma sensors for sensing radiation, such as naturally occurring radiation in the well borehole. The gamma module 114 is communicatively coupled to the downhole processor 108 and conductively coupled to the power module 112 to receive power from the power module 112. In embodiments, the gamma module 114 is communicatively coupled to the downhole processor 108 via one or more conductive paths. In embodiments, the gamma module 114 is wirelessly coupled to the downhole processor 108.

The second module 104 includes an uphole communication module 116 and an uphole processor 118. In embodiments, the uphole processor 118 is similar to the uphole processor 70 (shown in FIG. 1). In embodiments, the uphole communication module 106 is similar to the uphole communication module 72 (shown in FIG. 1).

The uphole processor 118 is communicatively coupled to the communication module 116. In embodiments, the uphole processor 118 is communicatively coupled to the communication module 116 via conductive paths or wires. In embodiments, the uphole processor 118 is wirelessly coupled to the communication module 116.

The downhole communication module 106 and the uphole communication module 116 communicate with each other via communications path 120. In embodiments, the communications path 120 is at least one of a fluidic medium, such as the drilling mud, and piping material, such as the metal piping of the drill string. In embodiments, the communications path is a wireless communications path for wirelessly communicating via electromagnetic waves.

In embodiments, the downhole communication module 106 and the uphole communication module 116 communicate via pressure pulses, such as mud pulse pressure signals. In embodiments, the downhole communication module 106 and the uphole communication module 116 communicate via acoustic signals, such as acoustic mud pulse signals or acoustic signals transmitted through the metal piping of the drill string. In embodiments, the downhole communication module 106 and the uphole communication module 116 communicate via electromagnetic waves, such as wirelessly or through a conductive path such as the metal piping of the drill string or another conductive path.

In one example of communication between the downhole communication module 106 and the uphole communication module 116, the downhole communication module 106 includes a pulser that is communicatively coupled to the downhole processor 108, and the uphole communication module 116 includes a pressure transducer that is communicatively coupled to the uphole processor 118. The pulser is situated at the distal end of the drill string and configured to provide a pressure pulse in the fluidic medium, such as the drilling mud, and the pressure transducer is situated at the proximal end of the drill string and configured to receive the pressure pulse in the fluidic medium. In embodiments, the pulser is a mud pulse valve. In embodiments, the pulser is electrically coupled to the downhole processor 108. In embodiments, the pressure transducer is electrically coupled to the uphole processor 118.

In this example, the downhole processor 108 transmits signals to the uphole communication module 116 by directing the pulser to provide pressure pulses in the fluidic medium. The pressure transducer operates as a sensor to sense the pressure pulses provided by the pulser, and the uphole processor 118 receives signals from the pressure transducer. In embodiments, the uphole processor 118 receives signals directly from the pressure transducer. In embodiments, the uphole processor 118 receives filtered signals that are received from an analog signal front end interposed between the pressure transducer and the uphole processor 118.

In embodiments, the downhole processor 108 determines if an orientation of the drill string in the well borehole is on the drill plan or off the drill plan. In embodiments, the downhole processor 108 compares one or more orientation values, such as the inclination of the drill string, to one or more threshold values and determines one or more of which well segment the drill string is in and whether the orientation of the drill string is on the drill plan or off the drill plan. In embodiments, the downhole processor 108 compares one or more of the calculated inclination and/or azimuth of the drill string to one or more threshold values to determine if the orientation of the drill string in the well borehole is on the drill plan or off the drill plan.

In embodiments, the downhole processor 108 determines if a position of the drill string in the well borehole is on the drill plan or off the drill plan. In embodiments, the downhole processor 108 determines the position of the drill string in the well borehole using pipe length measurements and/or drilled distance measurements and survey data to determine the position of the drill string in the well borehole and/or in the drill plan. Using this information, the downhole processor 108 determines whether the position of the drill string in the well borehole is on the drill plan or off the drill plan.

In embodiments, the drill plan is pre-programmed into the downhole processor 108, such that the downhole processor 108 compares the orientation and/or the position of the drill string to the pre-programmed well drill plan. In embodiments, the drill plan is communicated to the downhole processor 108 via communications path 120 during drilling operations, such that the downhole processor 108 compares the orientation and/or the position of the drill string to the received drill plan information.

The downhole processor 108 takes one or more surveys of the orientation of the drill string in the well borehole to determine whether the drill string is on the drill plan or off the drill plan. In embodiments, the downhole processor 108 takes multiple axis surveys, such as six-axis surveys. In embodiments, the downhole processor 108 determines calculated surveys of the drill string. In embodiments, the downhole processor 108 determines the calculated survey values from the six-axis survey values.

These surveys contain orientation data that is used to navigate downhole and control the well path trajectory. The calculated survey includes measurements, such as inclination and azimuth, that are calculated by the downhole processor 108. In embodiments, the downhole processor 108 transmits the calculated survey values with one or more quality control measurements that ensure the integrity of the calculated survey values. These quality control measurements are evaluated against expected measurement values for a given well site and used to determine whether the calculated survey values are good.

The six-axis survey includes three axes of accelerometer data (AX, AY, and AZ) and three axes of magnetometer data (MX, MY, and MZ). In embodiments, one or more axis of accelerometer data is transmitted to the surface. In embodiments, the measured total gravity is calculated from the six-axis data and transmitted to the surface. Also, in embodiments, the six-axis data is transmitted to the surface, such that inclination and azimuth can be calculated on the surface, which allows for corrections that cannot be applied by the downhole processor 108 to be applied on the surface.

To take the surveys, the downhole processor 108 receives sensor data from the orientation sensors 110, such as six-axis survey data. In embodiments, the orientation sensors 110 include a three-axis accelerometer 122 that provides the three axes of accelerometer data (AX, AY, and AZ). In embodiments, the orientation sensors 110 include a three-axis magnetometer 124 that provides the three axes of magnetometer data (MX, MY, and MZ).

After, the downhole processor 108 determines whether the drill sting is on the drill plan or off the drill plan, the downhole processor 108 transmits non-compressed survey signals if the drill string is off the drill plan and compressed survey signals if the drill string is on the drill plan. Also, in embodiments, the downhole processor 108 transmits at least one bit that indicates whether the drill string is on the drill plan or off the drill plan. In embodiments, the downhole processor 108 transmits the compressed or non-compressed survey signals periodically or based on a length of time between transmissions. In embodiments, the downhole processor 108 transmits the compressed or non-compressed survey signals based on a distance drilled between transmissions. In embodiments, if the drill string is off the drill plan, the downhole processor 108 transmits an error flag or another indication that indicates the drill string is off the drill plan.

The downhole processor 108 compresses survey data if the drill string is on the drill plan. This compression of the survey data, reduces the number of bits transmitted and the time it takes to make the transmission, which results in fewer transmission errors and more reliable information about the location of the drill string.

In one compression scheme, referred to as the well drill plan optimization compression scheme, the downhole processor 108 transmits deltas, i.e., differences, between measured values and expected values for a given well segment of the drill plan. This compression scheme relies on having accurate well site specific information, including the total gravity, the total magnetic field, and the dip angle. In embodiments, the well drill plan optimization compression scheme is used for transmitting at least some six-axis survey values.

For example, the following parameters are used in the well drill plan optimization compression scheme to compress data:

1) Total Gravity Resolution (GravResolution), which is the resolution at which the difference between the measured total gravity and the site specific total gravity is telemetered;
2) Expected Total Gravity (GravExpected), which is the site specific expected total gravity value;
3) Total Gravity Deviation (GravDeviation), which is the maximum expected deviation from the expected total gravity measurement;
4) Gravity Toolface Resolution (GTFResolution), which is the resolution of the gravity toolface measurement in degrees;
5) Accelerometer Axis Resolution (AccResolution), which is the resolution used for individual axis measurement;
6) Vertical Segment Threshold (VertThreshold), which is the inclination at which the distal end of the drill string is no longer deemed to be in the vertical segment of the well drill plan;
7) Horizontal Segment Threshold (HorizThreshold), which is the inclination at which the tool is no longer deemed to be in the horizontal segment of the well;
8) Inclination resolution (IncResolution), which is the resolution used for inclination measurements in the vertical or horizontal well segments;
9) Azimuth resolution (Azm Resolution), which is the resolution used for azimuth measurements in the curved and horizontal portions of the well;
10) Azimuth Segment Threshold (AzmThreshold), which is the azimuth range allowed for the curved and horizontal portions of a well;
11) Azimuth Target (AzmTarget), which is the targeted azimuth for the curved and lateral portions of a well;
12) Total Magnetic Field Resolution (MagFResolution), which is the resolution at which the difference from the measured total magnetic field is telemetered;
13) Expected Total Magnetic Field (MagFExpected), which is the site specific expected total magnetic field measurement;
14) Total Magnetic Field Deviation (MagFDeviation), which is the maximum expected deviation from the nominal total magnetic field;
15) Magnetic Toolface Resolution (MTFResolution), which is the resolution of the magnetic toolface measurement in degrees;
16) Magnetometer Z Axis Curve Deviation (MZCurveDeviation), which is the expected MZ deviation in the curved portion of the well. MZ changes in the curve are expected to be more significant than in the lateral or vertical segments of the well;
17) Magnetometer Z Axis Lateral Deviation (MZLatDeviation), which is the expected MZ deviation in the horizontal segment of the well. MZ changes in the horizontal are expected to be minimal; and
18) Magnetometer Z Axis Resolution (MZResolution)—the resolution at which the magnetometer Z axis (MZ) will be encoded at.

In the vertical well segment of the drill plan, it is expected that the measured total gravity is equal to the expected total gravity, the Z axis is positive, and the deviation from 0 degrees inclination is small, which restricts the maximum expected axis values of each of AX and AY. The AX and AY data and the measured total gravity data are telemetered, where the maximum deviation from the expected total gravity is calculated based on the VertThreshold and the number of bits required to represent this deviation is calculated from the GravResolution, and the maximum expected value for each of AX and AY is calculated based on the VertThreshold and the number of bits required to represent it is calculated from the AccResolution.

The well drill plan optimization compression scheme for the vertical well segment includes the following:

1) Calculate the maximum deviation from the expected total gravity for a given VertThreshold. For example, if the VertThreshold is 12 degrees and the expected total gravity is 0.998 gees, the maximum deviation from the total gravity at 12 degrees is about 23.8 miligees;
2) Determine the number of bits needed to represent this deviation, where the sign is known. For example, to represent 23.8 miligees using a GravResolution of 200 microgees, at least 119 values or 7 bits of data, can be used;
3) Encode the 7 bits of deviation data;
4) Calculate the maximum value needed for each of AX and AY by taking tan (θ), where θ is the inclination. For example, for 12 degrees of inclination this is 0.2125 gees. With an AccResolution of 1 milligee, 8 bits of data plus one sign bit are needed to represent each of AX and AY;
5) Encode the values of AX and AY; and
6) Transmit the encoded 7 bits of deviation data and the encoded 18 bits of AX and AY data.
7) When decoding the received data at the surface, the uphole processor 118 solves for AZ using the following equation: $Z=\sqrt{G^2-X^2-Y^2}$.

In embodiments, the downhole processor 108 is configured to perform one or more, and up to all, of the steps 1-6 described above. In embodiments, the downhole processor 108 is pre-programmed with one or more of threshold values, resolution values, and the number of bits to be used for compression.

Thus, for example, in the vertical well segment, using the well drill plan optimization compression scheme, the number of bits to be transmitted is reduced from 12 bits of gravity data, which is an example of the number of bits of gravity data otherwise transmitted, to 7 bits of deviation data that indicates the difference in the measured total gravity from the expected total gravity, and the number of bits to be transmitted is reduced from 12 bits of axis data for each of AX and AY, which is an example of the number of bits of axis data otherwise transmitted, to 9 bits of axis data for each of AX and AY.

In the horizontal or lateral well segment, the AZ measurement will be small, and not changing significantly, and the AX and AY measurements will potentially be large, such as up to the total gravity measurement. In embodiments, a method for compressing the six-axis inclination survey in the lateral portion of the well segment is as follows:

1) For example, let the HorizThreshold value be 5 degrees, such that a measurement of 90 degrees+/−5 degrees is considered to be in the horizontal well segment;
2) Calculate how many miligees deviation from horizontal the HorizThreshold is equivalent to. Calculate the measurement on AZ that corresponds to 5 degrees deviation from horizontal, assuming a total gravity of 0.998 gees: sin(θ) where θ is the HorizThreshold of 5 degrees, which results in 87 miligees;
3) To compress +/−87 miligees using a 400 microgee resolution, 9 bits can be used to encode the value of AZ;
4) The number of bits needed to compress total gravity can be calculated from the total gravity resolution as defined by (GravResolution) and the total gravity deviation (GravDeviation) setting. For example, if the expected total gravity (GravExpected) is 998.0 miligees, with the GravResolution set to 200 microgees, and the GravDeviation set to +/−3 miligees, then 5 bits are needed to transmit the total gravity measurement;
5) Similarly, for the gravity toolface, the total number of bits needed to transmit the gravity toolface measurement is determined by taking the GTFResolution and calculating the necessary bits to transmit the measurement at the required resolution. For example, if GTFResolution is 1 degree, then 360 discrete values are needed to transmit gravity toolface. To achieve this, 9 bits are needed to transmit the measurement at the required resolution; and
6) The AX and AY values can then be calculated from the gravity toolface (GTF), the total gravity (Gray), and the AZ values, resulting in the full values of AX, AY, and AZ as the output.

In embodiments, the calculated inclination survey compression in the horizontal or lateral well segment is as follows:

1) For example, let the IncResolution be 0.1 degrees, and the HorizThreshold value be 5 degrees, meaning that 90 degrees+/−5 degrees is considered to be in the lateral well segment;
2) The number of discrete values needed to represent inclination with a resolution of 0.1 degrees and a HorizThreshold of 5 degrees is 100, which can be encoded in 7 bits for the horizontal or lateral well segment.

In embodiments, the calculated azimuth survey compression in the curved and the lateral well segments of the well path are as follows:

1) Having the well plan pre-programmed into the downhole tool, allows the downhole tool to know what azimuth the curved and lateral well segments of the well will be at;
2) For example, let the Azm Resolution be 0.2 degrees, the AzmThreshold value be 5 degrees, and the AzmTarget value be 10 degrees. Thus, the azimuth needs to be at 10 degrees+/−5 degrees to be compressed in the curved and lateral well segments of the well path;
3) The number of discrete values needed to represent azimuth with a resolution of 0.2 degrees and a AzmThreshold of 5 degrees is 50, which can be encoded in 6 bits for the azimuth value in the curved or lateral well segment portions of a well, given that the azimuth value stays within the AzmThreshold from the AzmTarget.

In embodiments, the six-axis azimuth survey compression in the lateral well segment of the well path is as follows:

1) Having the well plan pre-programmed into the downhole tool allows the downhole tool to know the azimuth that the curved and lateral segments of the well need to be at. Using this information, the tool can calculate the expected MZ for the curved and lateral well segments of the well;

2) For example, let the MZLatResolution be 23 nanoteslas, the AzmThreshold value be 5 degrees, and the AzmTarget value be 10 degrees. Thus, the azimuth must be at 10 degrees+/−5 degrees to be compressed in the curved and lateral well segments of the well path;
3) With an expected total magnetic field value (MagFExpected) of 47,000 nanoteslas, MZ will range from 46821.2 to 45398.5 nanoteslas, with an expected value of 46286. The range of MZ values that can be compressed with the configuration described above is then 46,286 nanoteslas+/−711 nanoteslas;
4) With a resolution of 23 nanoteslas for the magnetometer Z axis (MZResolution), 6 bits can be used for MZ. If the sign of MZ can change (e.g. drilling east/west) then a sign bit is included;
5) To calculate the MX and MY values, the MTFResolution, the MagFExpected, the MagFResolution, and the MagFDeviation are required;
6) The magnetic toolface value will be transmitted with the resolution specified by MTFResolution, for example 1 degree. This requires 360 discrete values, such that 9 bits are used;
7) The deviation from the MagFExpected is then transmitted with the resolution of MagFResolution and within the range of MagFDeviation. For example, if MagFExpcted is 47000 nanoteslas, MagFResolution is 20 nanoteslas, and the MagFDeviation is +/−1000 nanoteslas, then 100 discrete values are needed to represent the total magnetic field (MagF) with the specified resolution, such that 7 bits are used to encode MagF; and
8) The MX and MY values are calculated from the magnetic toolface (MTF), the total magnetic field (MagF), and the MZ values, which results in the full values of MX, MY, and MZ as the output.

The well drill plan optimization compression scheme can be used in at least the vertical well segment and the lateral well segment of the drill plan. Also, in embodiments, the well drill plan optimization compression scheme can be used in the curved well segment. In embodiments, a similar compression scheme is used for transmitting calculated survey values, such as inclination and/or azimuth.

In another compression scheme, referred to as the expected optimization compression scheme, deltas, i.e., differences, between the measured survey values and the expected survey values are encoded and transmitted by the downhole processor 108. The expected optimization compression scheme relies on the idea that many of the survey parameters along the drill path will be close to expected survey values. In embodiments, the expected optimization compression scheme is used for transmitting calculated surveys.

In the expected optimization compression scheme, one or more of the following parameters are used:

1) Total Gravity Resolution (GravResolution), which is the resolution at which the difference between the measured total gravity and the site specific total gravity is telemetered;
2) Total Gravity Deviation (GravDeviation), which is the maximum expected deviation from the expected total gravity;
3) Total Magnetic Field Resolution (MagFResolution), which is the resolution at which the difference between the measured total magnetic field and the expected total magnetic field is telemetered;
4) Total Magnetic Field Deviation (MagFDeviation), which is the maximum expected deviation from the expected total magnetic field;
5) Dip Angle Resolution (DipAResolution), which is the resolution at which the difference between the measured dip angle and the expected dip angle is telemetered; and
6) Dip Angle Deviation (DipADeviation), which is the maximum expected deviation from the expected dip angle;
7) Inclination Resolution (IncResolution), which is the resolution at which the inclination measurement is telemetered;
8) Inclination Deviation (IncDeviation), which is the maximum expected inclination deviation in a given well segment, for example, in the vertical well segment this value may be 12 degrees;
9) Expected Total Magnetic Field (MagFExpected), which is the site specific expected total magnetic field measurement.

In operation, the expected optimization compression scheme for calculated surveys includes the following steps:

1) Acquire a six-axis survey from the orientation sensors 110;
2) Determine a calculated survey;
3) Evaluate the calculated survey measurements against corresponding maximum deviation thresholds, e.g., GravDeviation and IncDeviation, and determine whether they are within the allowed amount of deviation;
4) If all the calculated survey measurements are within the allowed deviation thresholds, transmit a compressed calculated survey, including deltas of the measured survey values from the expected values; and
5) If not all the calculated survey measurements are within the allowed deviation thresholds, transmit an uncompressed or non-compressed calculated survey. In some embodiments, if one or more of the calculated survey measurements are not within the allowed deviation thresholds, an error flag or another indication that the measurements are not within the allowed deviation thresholds is transmitted. In some embodiments, if one or more of the calculated survey measurements are not within the allowed deviation thresholds, an error flag or another indication indicating which measurements are not within the allowed deviation thresholds is transmitted.

In embodiments, an example of compressing the total magnetic field value is as follows:

1) Taking the expected total magnetic field (MagFExpected), the total magnetic field deviation (MagFDeviation), and the total magnetic field resolution (MagFResolution), the minimum number of bits required to transmit the deviation from the MagFExpected is calculated;
2) For example, if the expected total magnetic field is 47,000 nanotesla, with a total magnetic field deviation of +/−1000 nanoteslas, and a total magnetic field resolution of 20 nanoteslas, then 7 bits are used to transmit the total magnetic field measurement if the total magnetic field measurement is within the total magnetic field deviation from the expected total magnetic field.

In embodiments, the same or similar techniques are used for all other environmental variables (e.g. total gravity measurement, dip angle measurement).

In an example of transmitting non-compressed delta values as opposed to transmitting compressed values for inclination. The inclination of the drill string is from 0 degrees vertically down to 180 degrees vertically up, and the azimuth of the drill string is from 0 degrees to 360 degrees. With inclination represented by 12 bits of data, the resolution of the inclination transmitted to the surface can be less than 0.05 degrees. If one of the calculated survey values are outside a threshold value, the drill string is off the drill plan, and the downhole processor transmits non-compressed data of 12 bits, which represents the inclination.

However, if the drill string is determined to be on the drill plan, then the delta or deviation of the drill string from the drill plan can be transmitted to indicate the orientation of the drill string, which reduces the number of bits transmitted to the surface. For example, in a vertical segment A of the drill plan, the inclination is expected to be 0 degrees vertically down. For the drill string to be on the drill plan, the drill string is determined to be within a threshold, such as within plus or minus 5 degrees of the expected 0 degrees vertically down. At the same resolution of 0.05 degrees, this +/−5 degrees can be represented by 200 different values. Thus, only 8 bits of data need to be transmitted to the surface to represent the inclination. This is a reduction from 12 bits of non-compressed inclination data to 8 bits of compressed inclination data.

In embodiments, if the drill string is on the drill plan in the vertical segment, the downhole processor 108 does not transmit an azimuth value, or, in embodiments, the downhole processor 108 transmits a default azimuth value.

In embodiments, the downhole processor 108 is configured to perform one or more, and up to all, of the steps 1-5 described above. In embodiments, the downhole processor 108 is pre-programmed with one or more of threshold values, resolution values, and the number of bits to be used for compressing the data into deltas.

Using the expected optimization compression scheme reduces the number of bits transmitted. In embodiments, a similar compression scheme can be used for transmitting, at least some of, the six-axis survey values, such as accelerometer data and/or magnetometer data.

In addition to the above compression schemes, in embodiments, the downhole processor 108 is configured to provide a continuous delta compression scheme. In this scheme, the downhole processor 108 obtains measured survey values and transmits deltas, i.e., changes, that represent the differences between the measured survey values and the last previously transmitted measured survey values. The continuous delta compression scheme is useful for transmitting survey measurements that do not change much over time. In embodiments, the downhole processor 108 transmits the deltas during drilling operations. In embodiments, the downhole processor 108 transmits the deltas as the drill string moves through the well borehole. In embodiments, the downhole processor 108 transmits deltas using the continuous delta compression scheme between surveys, such as between taking full six-axis surveys. In embodiments, the continuous delta compression scheme is applicable for transmitting continuous inclination and/or continuous azimuth measurements.

In operation, the downhole processor 108 determines whether the trajectory of the drill string is on the drill plan or off the drill plan and the downhole processor 108 transmits, via the downhole communication module 106, non-compressed survey signals if the drill string is off the drill plan and compressed survey signals if the drill string is on the drill plan. The uphole processor 118 receives, via the uphole communications module 116, the survey signals from the downhole processor 108 and, in embodiments, the uphole processor 118 displays the received survey signals and/or analyzed results on a display communicatively coupled to the uphole processor 118. Based on the received (and displayed) information, drilling personnel maintain or change the trajectory of the drill string in the well borehole to stay on the drill plan or return to the drill plan. Also, in embodiments, the drilling personnel can modify the drill plan during drilling operations and update the trajectory of the drill string to the new modified drill plan.

Figure 3:
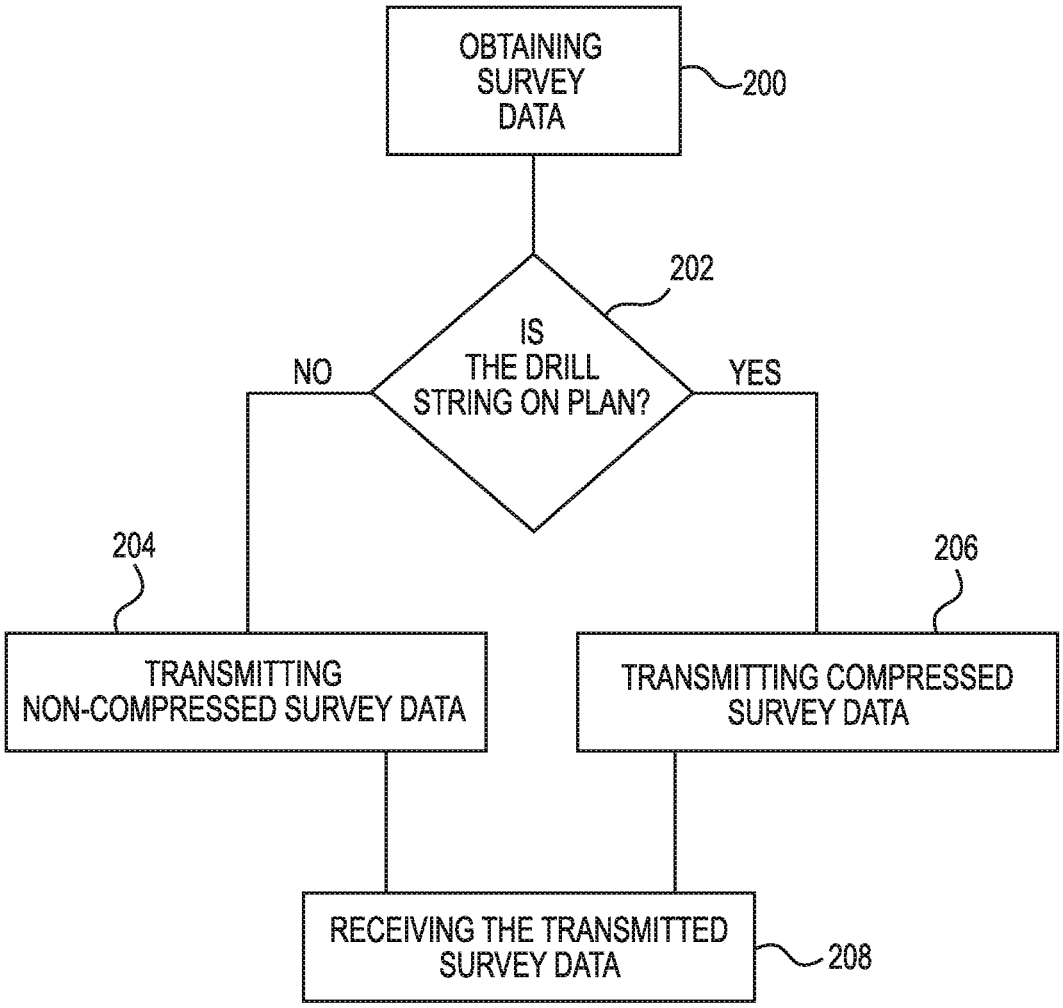
FIG. 3 is a flow chart diagram illustrating a method for communicating the well path trajectory of a drill string in a well borehole to the surface, according to embodiments of the disclosure.

FIG. 3 is a flow chart diagram illustrating a method for communicating the well path trajectory of a drill string in a well borehole to the surface, according to embodiments of the disclosure. In embodiments, the method can be provided by a MWD system, such as the MWD system 20 of FIG. 1 including the downhole processor 64, the downhole communications module 66, the uphole processor 70, and the uphole communications module 72, and the MWD system 100 of FIG. 2 including the downhole processor 108, the downhole communications module 106, the uphole processor 118, and the uphole communications module 116.

At 200, the method includes obtaining survey data, by the downhole processor, from at least one survey of the orientation of the drill string in the well borehole. To take a survey, the downhole processor receives sensor data from orientation sensors, such as orientation sensors 110. In embodiments, the survey data includes multiple axis survey data, such as six-axis survey data including three axes of accelerometer data (AX, AY, and AZ) and three axes of magnetometer data (MX, MY, and MZ). In embodiments, the survey data includes calculated survey values determined by the downhole processor, such as inclination and azimuth values determined by the downhole processor from the six-axis survey values.

At 202, the method includes determining, by the downhole processor, whether the drill string (or the well trajectory) is on the drill plan or off the drill plan. Where, in embodiments, the drill plan includes one or more well segments that define the contours of the finished well borehole. In embodiments, the drill plan includes a first vertical segment A, a second curved segment B, and a third lateral segment C. In other embodiments, the drill plan includes only one or two segments, or the drill plan includes more than three segments.

In embodiments, determining whether the drill string is on the drill plan or off the drill plan includes comparing, by the downhole processor, the orientation and/or the position of the drill string to the expected orientation and/or position of the drill string in the well borehole. In embodiments, the downhole processor compares one or more orientation values, such as the inclination of the drill string, to one or more threshold values. In embodiments, the downhole processor determines which well segment the drill string is in and whether the orientation of the drill string is on the drill plan or off the drill plan in the well segment. In embodiments, the downhole processor compares one or more of the calculated inclination and azimuth values to one or more threshold values to determine if the orientation of the drill string in the well borehole is on the drill plan or off the drill plan. In embodiments, determining whether the drill string is on the drill plan or off the drill plan includes determining the position of the drill string in the well borehole using pipe length measurements and/or drilled distance measurements with a pre-determined drill plan.

At 204, if the drill string is not on the drill plan, the method includes transmitting, by the downhole processor, non-compressed survey data or signals. In embodiments, transmitting non-compressed survey data includes transmitting the six-axis survey data to the surface, such that inclination and azimuth can be calculated on the surface, which allows for corrections that cannot be applied by the downhole processor. In embodiments, the measured total gravity is calculated by the downhole processor from the six-axis data and transmitted to the surface. In embodiments, transmitting non-compressed survey data includes transmitting the calculated survey values, including inclination and azimuth values. In embodiments, transmitting non-compressed survey data includes encoding the survey data, such as by one or more of pulse width modulation and pulse position modulation.

Transmitting non-compressed survey data as compared to compressed survey data to the surface includes transmitting a larger number of data bits to the surface. In embodiments, transmitting non-compressed survey data includes transmitting 12 bits of inclination data and 12 bits of azimuth data. In embodiments, transmitting survey data takes 1 second per bit, such that transmitting 24 bits including 12 bits of inclination data and 12 bits of azimuth data takes 24 seconds.

At 206, if the drill string is on the drill plan, the method includes transmitting, by the downhole processor, compressed survey data or signals. In embodiments, transmitting compressed survey data includes transmitting survey data that has been compressed by the downhole processor using the well drill plan optimization compression scheme described above. In embodiments, transmitting compressed survey data includes transmitting survey data that has been compressed by the downhole processor using the expected optimization compression scheme described above. In embodiments, transmitting compressed survey data includes encoding the survey data, such as by one or more of pulse width modulation and pulse position modulation.

In an example of transmitting non-compressed delta values as opposed to transmitting compressed values (e.g. inclination). The inclination of the drill string is from 0 degrees vertically down to 180 degrees vertically up, and the azimuth of the drill string is from 0 degrees to 360 degrees. With inclination represented by 12 bits of data the resolution of the inclination transmitted to the surface can be less than 0.05 degrees. If one of the calculated survey values are outside a threshold value, the drill string is off the drill plan, and the downhole processor transmits non-compressed 12 bits of data, which represents the inclination.

However, if the drill string is determined to be on the drill plan, then the delta or deviation of the drill string from the drill plan can be transmitted to indicate the orientation of the drill string, which reduces the number of bits transmitted to the surface. For example, in a vertical segment A of the drill plan, the inclination is expected to be 0 degrees vertically down. For the drill string to be on the drill plan, the drill string is determined to be within a threshold, such as within plus or minus 5 degrees of the expected 0 degrees vertically down. At the same resolution of 0.05 degrees, this +/−5 degrees can be represented by 200 different values. Thus, only 8 bits of data need to be transmitted to the surface to represent the inclination. This is a reduction from 12 bits of non-compressed inclination data to 8 bits of compressed inclination data.

In embodiments, if the drill string is on the drill plan in the vertical segment, the downhole processor 108 does not transmit an azimuth value, or, in embodiments, the downhole processor 108 transmits a default azimuth value.

Also, for example, in a lateral segment C of the drill plan, the inclination is expected to be 90 degrees and, in embodiments, the azimuth can be expected to be a pre-determined plan value from 0 degrees to 360 degrees. For the drill string to be on the drill plan, the drill string must be within a first threshold, such as within plus or minus 5 degrees of the expected 90 degrees, and within a second threshold, such as within plus or minus 5 degrees of the expected pre-determined azimuth plan value. If the inclination and azimuth are within the first and second thresholds, respectively, only 7 bits of data representing up to 128 different values is transmitted to the surface for each of the inclination and the azimuth. This is a reduction from 12 bits of non-compressed inclination data to 7 bits of compressed inclination data, and a reduction from 12 bits of non-compressed azimuth data to 7 bits of compressed azimuth data. In embodiments, if the drill string inclination is on the drill plan in the lateral segment, the downhole processor transmits a compressed inclination value and a non-compressed azimuth value.

In addition, for example, in a curved segment B of the drill plan, the inclination can be expected be a pre-determined inclination value, and the azimuth can be expected to be a pre-determined azimuth value from 0 degrees to 360 degrees. For the drill string to be on the drill plan, the drill string must be within a first threshold, such as within plus or minus 5 degrees of the expected pre-determined inclination value, and within a second threshold, such as within plus or minus 5 degrees of the expected pre-determined azimuth value. If the inclination and azimuth are within the first and second thresholds, respectively, only 7 bits of data representing 128 different values is transmitted to the surface for each of the inclination and the azimuth. This is a reduction from 12 bits of non-compressed inclination data to 7 bits of compressed inclination data, and a reduction from 12 bits of non-compressed azimuth data to 7 bits of compressed azimuth data.

In embodiments, the pre-determined inclination plan value and/or the pre-determined azimuth plan value are pre-programmed into the downhole processor, such that the downhole processor compares the orientation of the drill string to the pre-programmed plan value. In embodiments, the pre-determined inclination plan value and/or the pre-determined azimuth plan value are communicated to the downhole processor via the communications path during drilling operations, such that the downhole processor compares the orientation of the drill string to the received pre=programmed drill plan information.

In embodiments, the downhole processor transmits a single bit to the surface to indicate whether the drill string is on the drill plan or off the drill plan. In embodiments, the uphole processor uses the number of bits received by the uphole processor to determine whether the drill string is on the drill plan or off the drill plan. Also, in embodiments, the downhole processor transmits the non-compressed/compressed survey data based on the distance drilled since the last previous transmission and, in embodiments, the downhole processor transmits the non-compressed/compressed survey data based on the time that has expired since the last previous transmission of data.

At 208, the method includes receiving, by the uphole processor, the transmitted survey data or signals, such as the non-compressed survey data and the compressed survey data. In embodiments, the uphole processor receives non-compressed six-axis survey values and the uphole processor determines calculated survey values. In embodiments, the uphole processor receives non-compressed calculated survey values.

In embodiments, the non-compressed survey data and the compressed survey data are encoded, such as by pulse width modulation or pulse position modulation schemes, and the uphole processor decodes the received modulated signals to obtain the non-compressed survey signals and the compressed survey signals. In embodiments, the uphole processor determines one or more of six-axis survey values and calculated survey values from the delta or deviation compressed survey values.

In embodiments, the method further includes transmitting, by the downhole processor, delta compressed survey data, such as partial survey data, between transmissions of the compressed and non-compressed survey data described above. The downhole processor obtains one or more measured survey values and transmits deltas, i.e., changes, between the measured survey values and the last previously transmitted survey values. The uphole processor receives the deltas and determines survey values from the deltas. This continuous delta compression scheme is useful for transmitting survey measurements that do not change much over time. In embodiments, the downhole processor transmits the deltas during drilling operations. In embodiments, the downhole processor transmits the deltas as the drill string moves through the well borehole. In embodiments, the downhole processor transmits deltas using the continuous delta compression scheme between surveys, such as between taking full six-axis surveys. In embodiments, the continuous delta compression scheme is applicable for transmitting continuous inclination and/or continuous azimuth measurements.

FIGS. 4A-4D are flow chart diagrams illustrating a method for communicating the well path trajectory of a drill string to the surface for a well plan having three well segments, according to embodiments of the disclosure. In embodiments, the method can be provided by a MWD system, such as the MWD system 20 of FIG. 1 including the downhole processor 64, the downhole communications module 66, the uphole processor 70, and the uphole communications module 72, and the MWD system 100 of FIG. 2 including the downhole processor 108, the downhole communications module 106, the uphole processor 118, and the uphole communications module 116.

Figure 4A:
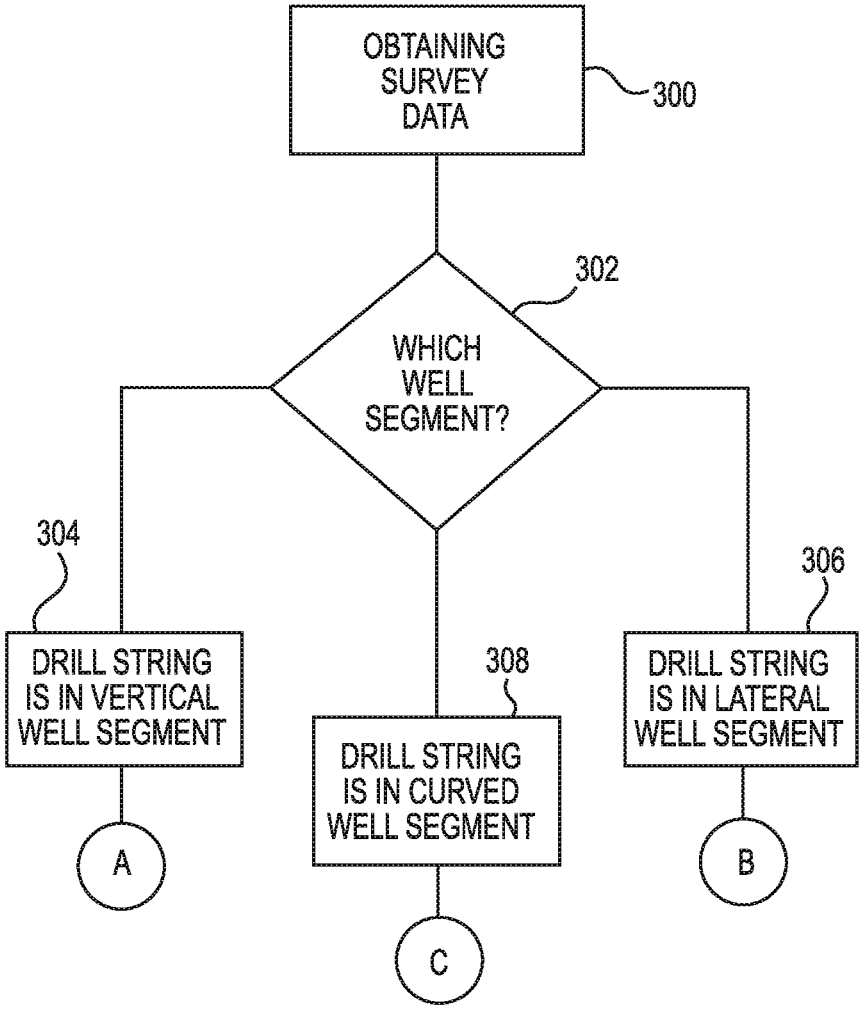
FIG. 4A is a flow chart diagram illustrating a method for determining which well segment of the three well segments the drill string is in, according to embodiments of the disclosure.

FIG. 4A is a flow chart diagram illustrating a method for determining which well segment of the three well segments the drill string is in, according to embodiments of the disclosure. At 300, the method includes obtaining survey data, by the downhole processor, from at least one survey of the orientation of the drill string in the well borehole. To take a survey, the downhole processor receives sensor data from orientation sensors, such as orientation sensors 110. In this method, the downhole processor determines the inclination of the drill string in the well borehole from the survey data. In embodiments, the survey data includes multiple axis survey data, such as six-axis survey data including three axes of accelerometer data (AX, AY, and AZ) and three axes of magnetometer data (MX, MY, and MZ). In embodiments, the survey data includes calculated survey values determined by the downhole processor, such as inclination and azimuth values determined by the downhole processor from the six-axis survey values.

At 302, the method includes determining, by the downhole processor, which well segment the drill string is in based on the inclination of the drill string. In this example, the drill plan includes three well segments that define the contours of the finished well borehole and the method includes determining which well segment of the three well segments the drill string is in based on the inclination of the drill string. The drill plan includes a first vertical segment A, a second curved segment B, and a third lateral segment C. In other embodiments, the drill plan includes only one or two well segments, or the drill plan includes more than three well segments, such that the method includes determining which well segment of the one or two well segments, or which well segment of the more than three well segments, the drill string is in based on the inclination of the drill string.

In determining which well segment the drill string is in, the method includes comparing, by the downhole processor, the inclination of the drill string to up to two or more thresholds, such as a vertical threshold and a lateral threshold.

To determine whether the drill string is in the vertical well segment A, the downhole processor compares the inclination of the drill string to the vertical threshold. In vertical well segment A, the expected inclination is 0 degrees and the vertical threshold is the distance, in degrees, from 0 degrees, which is used to determine whether the drill string is in the vertical well segment A. If the inclination of the drill string is less than the vertical threshold, the downhole processor determines that the drill string is in the vertical well segment A and processing continues at 304. If the inclination of the drill string is greater than or equal to the vertical threshold, the drill string is in either the curved well segment B or the lateral well segment C. In embodiments, the vertical threshold is 12 degrees.

To determine whether the drill string is in the lateral well segment C, the downhole processor compares the inclination of the drill string to the lateral threshold. In the lateral well segment C, the expected inclination is 90 degrees. The lateral threshold is the distance, in degrees, from 0 degrees, which is used to determine whether the drill string is in the lateral well segment C. If the inclination of the drill string is greater than the lateral threshold, the downhole processor determines that the drill string is in the lateral well segment C and processing continues at 306. If the inclination of the drill string is less than or equal to the lateral threshold, the drill string is in either the vertical well segment A or the curved well segment B. In embodiments, the vertical threshold is 80 degrees.

To determine whether the drill string is in the curved well segment B, the downhole processor compares the inclination of the drill string to the vertical threshold and to the lateral threshold. If the inclination of the drill string is greater than or equal to the vertical threshold and less than or equal to the lateral threshold, the downhole processor determines that the drill string is in the curved well segment C and processing continues at 308.

Figure 4B:
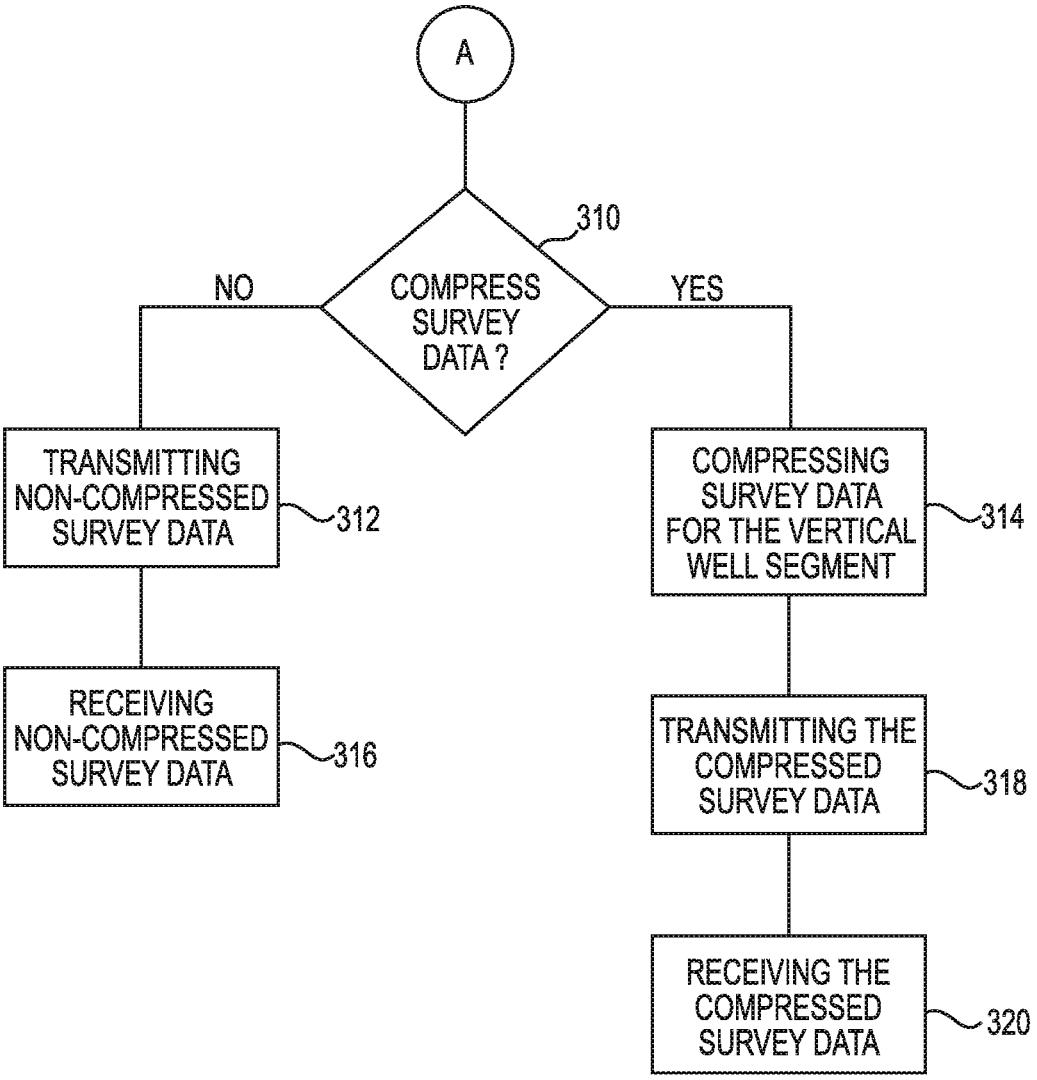
FIG. 4B is a flow chart diagram illustrating transmitting and receiving survey data after the downhole processor has determined that the drill string is in the vertical well segment, according to embodiments of the disclosure.

FIG. 4B is a flow chart diagram illustrating transmitting and receiving survey data after the downhole processor has determined that the drill string is in the vertical well segment A at 304, according to embodiments of the disclosure. At 310, in embodiments, the method includes determining, by the downhole processor, whether or not to compress the survey data.

In embodiments, determining whether to compress the survey data includes determining whether the drill string is on the drill plan or off the drill plan. In embodiments, determining whether the drill string is on the drill plan or off the drill plan includes comparing, by the downhole processor, the inclination of the drill string to a drill plan vertical threshold. If the inclination of the drill string is greater than the drill plan vertical threshold, the downhole processor continues processing at 312, where the downhole processor transmits non-compressed survey data. If the inclination of the drill string is less than the drill plan vertical threshold, the downhole processor continues processing at 314, where the downhole processor compresses survey data and transmits compressed survey data. In embodiments, the drill plan vertical threshold is the same as the vertical threshold used to determine whether the drill sting is in the vertical well segment A, such that, in embodiments, the downhole processor always compresses the survey data and transmits compressed survey data, unless the survey data is determined to be invalid. In embodiments, the drill plan vertical threshold is less than the vertical threshold used to determine whether the drill sting is in the vertical segment A. In embodiments the drill plan vertical threshold is 5 degrees.

In embodiments, determining whether to compress the survey data includes determining whether the survey data is valid survey data, such that the sensors are working properly, and the sensor data acquired from the orientation sensors is reliable data. In embodiments, the downhole processor transmits compressed survey data unless one or more of the survey data values exceeds a valid data threshold value. In embodiments, if one or more of the survey values are determined to be invalid, such as by exceeding a valid data threshold value, the downhole processor continues processing at 312, where the downhole processor transmits non-compressed survey data. In embodiments, if the survey values are determined to be valid, the downhole processor can continue processing at 314, where the downhole processor compresses survey data and transmits compressed survey data.

At 312, the method includes transmitting, by the downhole processor, non-compressed survey data or signals. In embodiments, transmitting non-compressed survey data includes transmitting six-axis survey data to the surface, such that inclination and azimuth can be calculated on the surface, which allows for corrections that cannot be applied by the downhole processor. In embodiments, the measured total gravity is calculated by the downhole processor from six-axis survey data and transmitted to the surface. In embodiments, transmitting non-compressed survey data includes transmitting the calculated survey values, including inclination and azimuth values. In embodiments, transmitting non-compressed survey data includes encoding the survey data, such as by one or more of pulse width modulation and pulse position modulation, and transmitting the encoded (modulated) survey data.

At 316, the method includes receiving, such as by the uphole processor, the non-compressed survey data. In embodiments, the method includes receiving encoded non-compressed survey data and the method further includes decoding the encoded non-compressed survey data to obtain the non-compressed survey data. In embodiments, the method includes receiving non-compressed six-axis survey data and determining inclination and azimuth at the surface, which allows for corrections that cannot be applied by the downhole processor. In embodiments, the method includes receiving non-compressed calculated survey data, including inclination and azimuth. In embodiments, the method includes displaying the non-compressed survey data.

At 314, the method includes compressing, by the downhole processor, the survey data for the vertical well segment A. In embodiments, compressing the survey data for the vertical well segment A includes compressing the survey data according to the well drill plan optimization compression scheme for the vertical well segment, as described above. In embodiments, compressing the survey data for the vertical well segment A includes compressing the survey data according to the expected optimization compression scheme described above. In embodiments, compressing the survey data for the vertical well segment A according to the expected optimization compression scheme includes compressing deltas for the total gravity, total magnetic field, the dip angle, and the inclination.

At 318, the method includes transmitting, by the downhole processor, the compressed survey data or signals for the vertical well segment A. In embodiments, transmitting the compressed survey data includes transmitting survey data that has been compressed by the downhole processor using the well drill plan optimization compression scheme described above. In embodiments, transmitting compressed survey data includes transmitting survey data that has been compressed by the downhole processor using the expected optimization compression scheme described above. In embodiments, transmitting compressed survey data includes encoding the compressed survey data, such as by one or more of pulse width modulation and pulse position modulation, and transmitting the encoded (modulated) compressed survey data.

At 320, the method includes receiving, such as by the uphole processor, the compressed survey data. In embodiments, the method includes receiving encoded compressed survey data and decoding the encoded compressed survey data to obtain the compressed survey data. In embodiments, the method includes receiving the compressed survey data or encoded compressed survey data and providing non-compressed survey data from the compressed survey data. In embodiments, the method includes receiving compressed six-axis survey data and determining inclination and azimuth at the surface, which allows for corrections that cannot be applied by the downhole processor. In embodiments, the method includes receiving compressed calculated survey data and determining non-compressed survey data from the compressed survey data. In embodiments, the method includes displaying the compressed/non-compressed survey data.

In embodiments, the downhole processor transmits a single bit to the uphole processor to indicate whether the survey data is compressed or non-compressed survey data. In embodiments, the uphole processor uses the number of bits received by the uphole processor to determine whether the survey data is compressed or non-compressed.

Figure 4C:
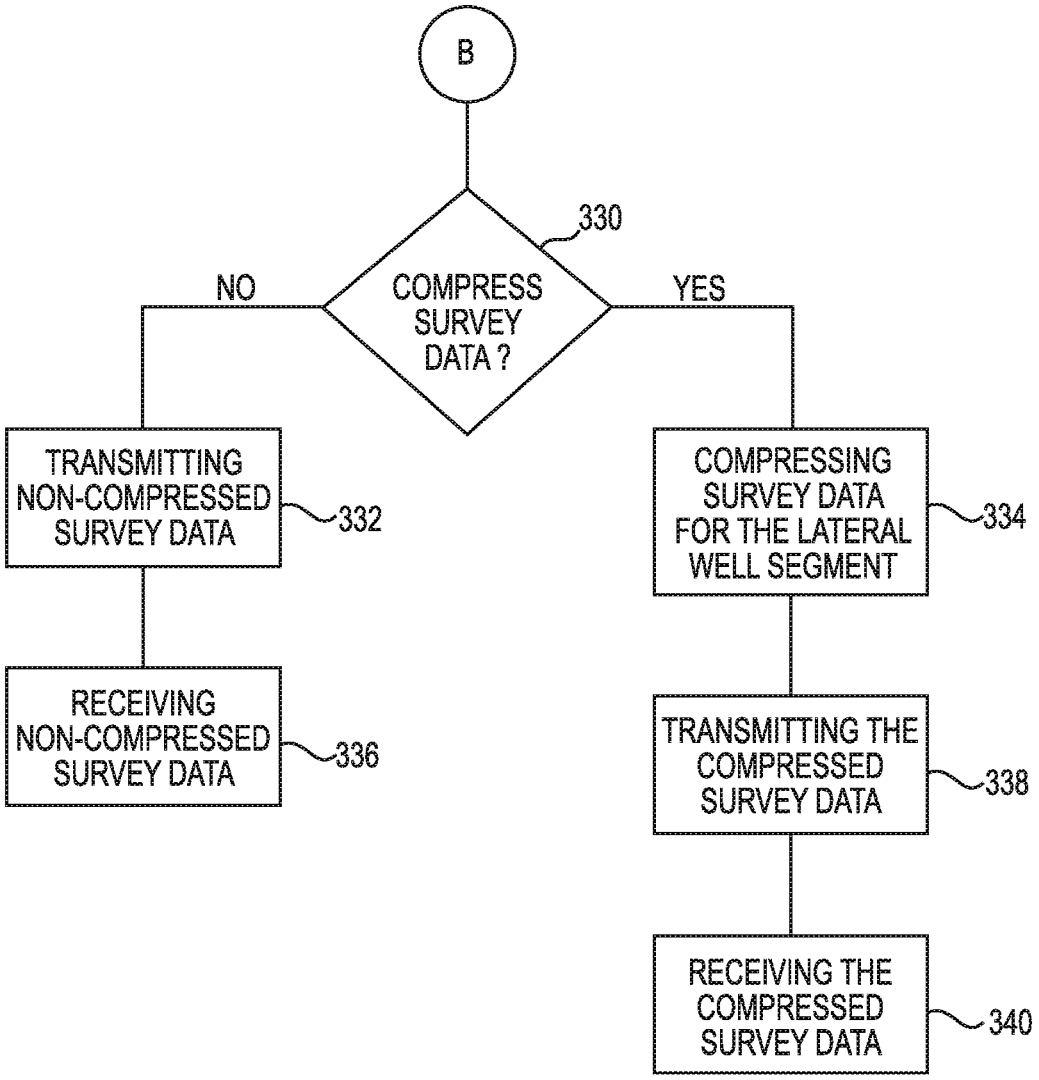
FIG. 4C is a flow chart diagram illustrating transmitting and receiving survey data after the downhole processor has determined that the drill string is in the lateral well segment, according to embodiments of the disclosure.

FIG. 4C is a flow chart diagram illustrating transmitting and receiving survey data after the downhole processor has determined that the drill string is in the lateral well segment C at 306, according to embodiments of the disclosure. At 330, in embodiments, the method includes determining, by the downhole processor, whether or not to compress the survey data.

In embodiments, determining whether to compress the survey data includes determining whether the drill string is on the drill plan or off the drill plan. In embodiments, determining whether the drill string is on the drill plan or off the drill plan includes comparing, by the downhole processor, the inclination of the drill string to a drill plan lateral threshold. If the inclination of the drill string is less than the drill plan lateral threshold, the downhole processor continues processing at 332, where the downhole processor transmits non-compressed survey data. If the inclination of the drill string is greater than the drill plan lateral threshold, the downhole processor continues processing at 334, where the downhole processor compresses survey data and transmits compressed survey data. In embodiments, the drill plan lateral threshold is the same as the lateral threshold used to determine whether the drill sting is in the lateral well segment C, such that, in embodiments, the downhole processor always compresses the survey data and transmits compressed survey data, unless the survey data is determined to be invalid. In embodiments, the drill plan lateral threshold is greater than the lateral threshold used to determine whether the drill sting is in the lateral segment C. In embodiments the drill plan lateral threshold is 85 degrees.

In embodiments, determining whether to compress the survey data includes determining whether the survey data is valid survey data, such that the sensors are working properly, and the sensor data acquired from the orientation sensors is reliable data. In embodiments, the downhole processor transmits compressed survey data unless one or more of the survey data values exceeds a valid data threshold value. In embodiments, if one or more of the survey values are determined to be invalid, such as by exceeding a valid data threshold value, the downhole processor continues processing at 332, where the downhole processor transmits non-compressed survey data. In embodiments, if the survey values are determined to be valid, the downhole processor can continue processing at 334, where the downhole processor compresses survey data and transmits compressed survey data.

At 332, the method includes transmitting, by the downhole processor, non-compressed survey data or signals. In embodiments, transmitting non-compressed survey data includes transmitting six-axis survey data to the surface, such that inclination and azimuth can be calculated on the surface, which allows for corrections that cannot be applied by the downhole processor. In embodiments, the measured total gravity is calculated by the downhole processor from six-axis survey data and transmitted to the surface. In embodiments, transmitting non-compressed survey data includes transmitting the calculated survey values, including inclination and azimuth values. In embodiments, transmitting non-compressed survey data includes encoding the survey data, such as by one or more of pulse width modulation and pulse position modulation, and transmitting the encoded (modulated) survey data.

At 336, the method includes receiving, such as by the uphole processor, the non-compressed survey data. In embodiments, the method includes receiving encoded non-compressed survey data and the method further includes decoding the encoded non-compressed survey data to obtain the non-compressed survey data. In embodiments, the method includes receiving non-compressed six-axis survey data and determining inclination and azimuth at the surface, which allows for corrections that cannot be applied by the downhole processor. In embodiments, the method includes receiving non-compressed calculated survey data, including inclination and azimuth. In embodiments, the method includes displaying the non-compressed survey data.

At 334, the method includes compressing, by the downhole processor, the survey data for the lateral well segment C. In embodiments, compressing the survey data for the lateral well segment C includes compressing the survey data according to the well drill plan optimization compression scheme, as described above. In embodiments, compressing the survey data for the lateral well segment C includes compressing the survey data according to the expected optimization compression scheme described above. In embodiments, compressing the survey data for the lateral well segment C according to the expected optimization compression scheme includes compressing deltas for the total gravity, the total magnetic field, the dip angle, the inclination, and the azimuth. In embodiments, compressing the survey data for the lateral well segment C according to the expected optimization compression scheme includes compressing deltas for the total gravity, the total magnetic field, the dip angle, and the inclination, and providing non-compressed azimuth survey data.

At 338, the method includes transmitting, by the downhole processor, the compressed survey data or signals for the lateral well segment C. In embodiments, transmitting the compressed survey data includes transmitting survey data that has been compressed by the downhole processor using the well drill plan optimization compression scheme described above. In embodiments, transmitting compressed survey data includes transmitting survey data that has been compressed by the downhole processor using the expected optimization compression scheme described above and, in embodiments, including at least one of compressed azimuth survey data and non-compressed azimuth survey data. In embodiments, transmitting compressed survey data includes encoding the compressed survey data, such as by one or more of pulse width modulation and pulse position modulation, and transmitting the encoded (modulated) compressed survey data.

At 340, the method includes receiving, such as by the uphole processor, the compressed survey data. In embodiments, the method includes receiving encoded compressed survey data and decoding the encoded compressed survey data to obtain the compressed survey data. In embodiments, the method includes receiving the compressed survey data or encoded compressed survey data and providing non-compressed survey data from the compressed survey data. In embodiments, the method includes receiving compressed six-axis survey data and determining inclination and azimuth at the surface, which allows for corrections that cannot be applied by the downhole processor. In embodiments, the method includes receiving compressed calculated survey data and determining non-compressed survey data from the compressed survey data. In embodiments, the method includes displaying the compressed/non-compressed survey data.

In embodiments, the downhole processor transmits a single bit to the uphole processor to indicate whether the survey data is compressed or non-compressed survey data. In embodiments, the uphole processor uses the number of bits received by the uphole processor to determine whether the survey data is compressed or non-compressed.

Figure 4D:
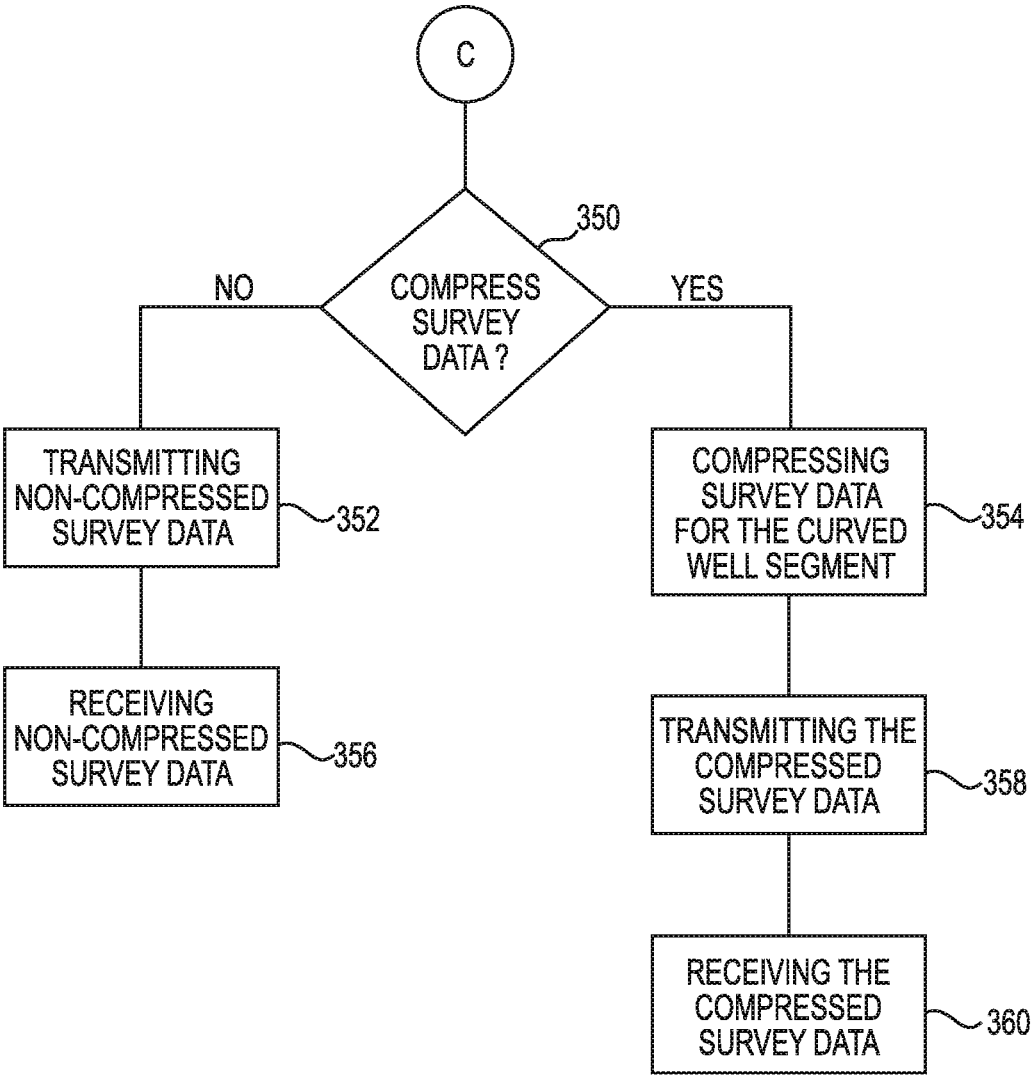
FIG. 4D is a flow chart diagram illustrating transmitting and receiving survey data after the downhole processor has determined that the drill string is in the curved well segment, according to embodiments of the disclosure.

FIG. 4D is a flow chart diagram illustrating transmitting and receiving survey data after the downhole processor has determined that the drill string is in the curved well segment B at 308, according to embodiments of the disclosure. At 350, in embodiments, the method includes determining, by the downhole processor, whether or not to compress the survey data. In embodiments, the method does not include transmitting any survey data after it has been determined that the drill string is not in one of the vertical well segment A and the lateral well segment C. In embodiments, the method includes transmitting only non-compressed survey data after it has been determined that the drill string is not in one of the vertical well segment A and the lateral well segment C.

In embodiments, determining whether to compress the survey data includes determining whether the drill string is on the drill plan or off the drill plan. In embodiments, determining whether the drill string is on the drill plan or off the drill plan includes comparing, by the downhole processor, the inclination of the drill string to one or more of a first curved threshold and a second curved threshold. If the inclination of the drill string is not between the first curved threshold and the second curved threshold, the downhole processor continues processing at 352, where the downhole processor transmits non-compressed survey data. If the inclination of the drill string is between the first curved threshold and the second curved threshold, the downhole processor continues processing at 354, where the downhole processor compresses survey data and transmits compressed survey data. In embodiments, the first curved threshold is the same as the vertical threshold used to determine whether the drill sting is in the curved well segment B and the second curved threshold is the same as the lateral threshold used to determine whether the drill sting is in the curved well segment B, such that, in embodiments, the downhole processor always compresses the survey data and transmits compressed survey data, unless the survey data is determined to be invalid. In embodiments, the first curved threshold is greater than the vertical threshold used to determine whether the drill sting is in the curved well segment B and the second curved threshold is less than the lateral threshold used to determine whether the drill sting is in the curved well segment B. In embodiments the first curved threshold is 20 degrees and the second curved threshold is 70 degrees.

In embodiments, determining whether to compress the survey data includes determining whether the survey data is valid survey data, such that the sensors are working properly, and the sensor data acquired from the orientation sensors is reliable data. In embodiments, the downhole processor transmits compressed survey data unless one or more of the survey data values exceeds a valid data threshold value. In embodiments, if one or more of the survey values are determined to be invalid, such as by exceeding a valid data threshold value, the downhole processor continues processing at 352, where the downhole processor transmits non-compressed survey data. In embodiments, if the survey values are determined to be valid, the downhole processor can continue processing at 354, where the downhole processor compresses survey data and transmits compressed survey data.

At 352, the method includes transmitting, by the downhole processor, non-compressed survey data or signals. In embodiments, transmitting non-compressed survey data includes transmitting six-axis survey data to the surface, such that inclination and azimuth can be calculated on the surface, which allows for corrections that cannot be applied by the downhole processor. In embodiments, the measured total gravity is calculated by the downhole processor from six-axis survey data and transmitted to the surface. In embodiments, transmitting non-compressed survey data includes transmitting the calculated survey values, including inclination and azimuth values. In embodiments, transmitting non-compressed survey data includes encoding the survey data, such as by one or more of pulse width modulation and pulse position modulation, and transmitting the encoded (modulated) survey data.

At 356, the method includes receiving, such as by the uphole processor, the non-compressed survey data. In embodiments, the method includes receiving encoded non-compressed survey data and the method further includes decoding the encoded non-compressed survey data to obtain the non-compressed survey data. In embodiments, the method includes receiving non-compressed six-axis survey data and determining inclination and azimuth at the surface, which allows for corrections that cannot be applied by the downhole processor. In embodiments, the method includes receiving non-compressed calculated survey data, including inclination and azimuth. In embodiments, the method includes displaying the non-compressed survey data.

At 354, the method includes compressing, by the downhole processor, the survey data for the curved well segment B. In embodiments, compressing the survey data for the curved well segment B includes compressing the survey data according to the well drill plan optimization compression scheme. In embodiments, compressing the survey data for the curved well segment B includes compressing the survey data according to the expected optimization compression scheme described above. In embodiments, compressing the survey data for the curved well segment B according to the expected optimization compression scheme includes compressing deltas for the total gravity, the total magnetic field, the dip angle, and one or more of the inclination and the azimuth. In embodiments, compressing the survey data for the curved well segment B according to the expected optimization compression scheme includes compressing deltas for the total gravity, the total magnetic field, and the dip angle, and providing one or more of non-compressed inclination data and azimuth data.

At 358, the method includes transmitting, by the downhole processor, the compressed survey data or signals for the curved well segment B. In embodiments, transmitting the compressed survey data includes transmitting survey data that has been compressed by the downhole processor using the well drill plan optimization compression scheme. In embodiments, transmitting compressed survey data includes transmitting survey data that has been compressed by the downhole processor using the expected optimization compression scheme described above and, in embodiments, including at least one of compressed azimuth survey data and non-compressed azimuth survey data. In embodiments, transmitting compressed survey data includes encoding the compressed survey data, such as by one or more of pulse width modulation and pulse position modulation, and transmitting the encoded (modulated) compressed survey data.

At 360, the method includes receiving, such as by the uphole processor, the compressed survey data. In embodiments, the method includes receiving encoded compressed survey data and decoding the encoded compressed survey data to obtain the compressed survey data. In embodiments, the method includes receiving the compressed survey data or encoded compressed survey data and providing non-compressed survey data from the compressed survey data. In embodiments, the method includes receiving compressed six-axis survey data and determining inclination and azimuth at the surface, which allows for corrections that cannot be applied by the downhole processor. In embodiments, the method includes receiving compressed calculated survey data and determining non-compressed survey data from the compressed survey data. In embodiments, the method includes displaying the compressed/non-compressed survey data.

In embodiments, the downhole processor transmits a single bit to the uphole processor to indicate whether the survey data is compressed or non-compressed survey data. In embodiments, the uphole processor uses the number of bits received by the uphole processor to determine whether the survey data is compressed or non-compressed.

In embodiments of the method of FIGS. 4A-4D, the downhole processor transmits the compressed/non-compressed survey data based on the distance drilled since the last previous transmission. In embodiments, the downhole processor transmits the compressed/non-compressed survey data based on the time that has expired since the last previous transmission of data.

Also, in embodiments of the method of FIGS. 4A-4D, the method includes transmitting, by the downhole processor, delta compressed survey data, such as partial survey data, between transmissions of the compressed/non-compressed survey data. The downhole processor obtains one or more measured survey values and transmits deltas, i.e., changes, between the measured survey values and the last previously transmitted survey values. The uphole processor receives the deltas and determines survey values from the deltas. This continuous delta compression scheme is useful for transmitting survey measurements that do not change much over time. In embodiments, the downhole processor transmits the deltas during drilling operations. In embodiments, the downhole processor transmits the deltas as the drill string moves through the well borehole. In embodiments, the downhole processor transmits deltas using the continuous delta compression scheme between surveys, such as between taking full six-axis surveys. In embodiments, the continuous delta compression scheme is applicable for transmitting continuous inclination and/or continuous azimuth measurements.

Figure 5:
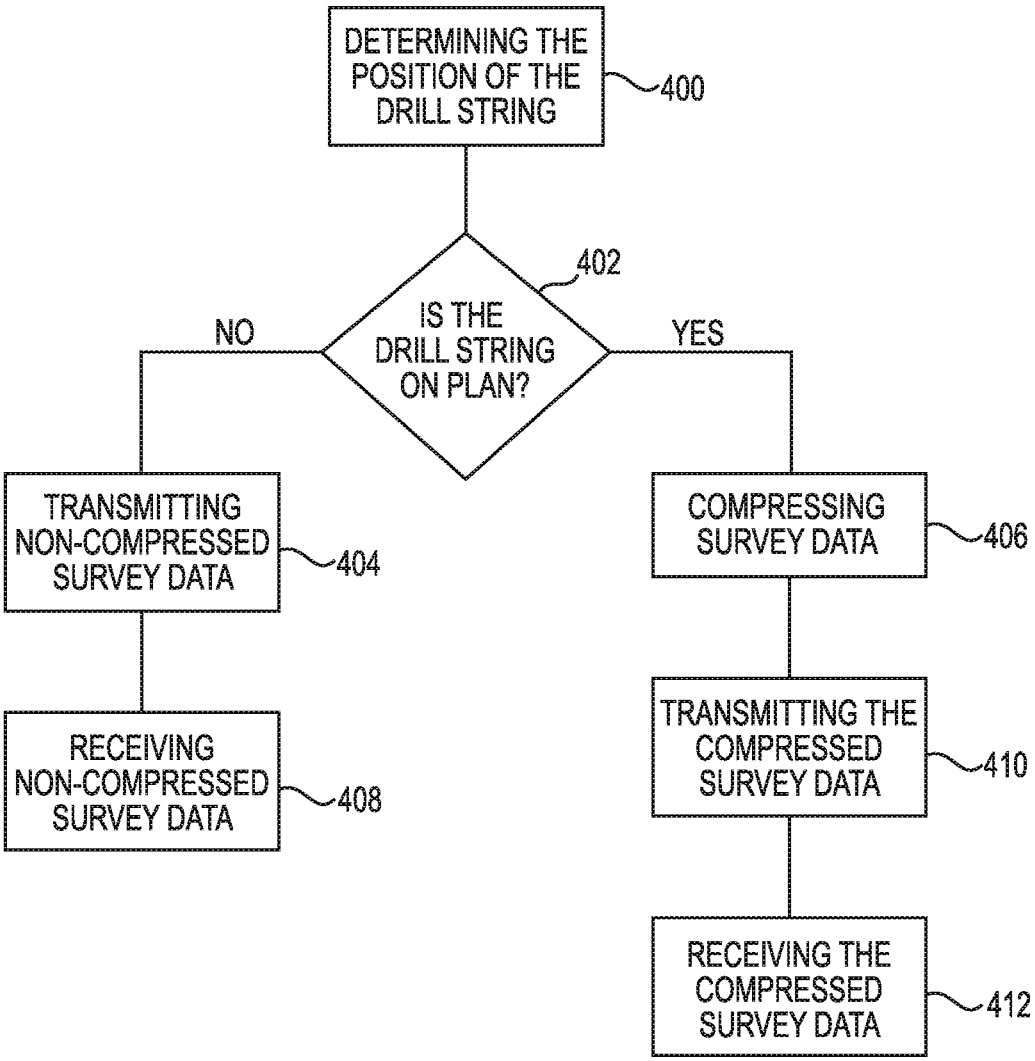
FIG. 5 is a flow chart diagram illustrating a method for communicating the well path trajectory of a drill string to the surface based on the position of the drill string in the well borehole, according to embodiments of the disclosure.

FIG. 5 is a flow chart diagram illustrating a method for communicating the well path trajectory of a drill string to the surface based on the position of the drill string in the well borehole, according to embodiments of the disclosure. In embodiments, the method can be provided by a MWD system, such as the MWD system 20 of FIG. 1 including the downhole processor 64, the downhole communications module 66, the uphole processor 70, and the uphole communications module 72, and the MWD system 100 of FIG. 2 including the downhole processor 108, the downhole communications module 106, the uphole processor 118, and the uphole communications module 116.

At 400, the method includes determining the position of the drill string in the well borehole based on survey data and the distance drilled during drilling operations. Using the survey data and the distance drilled, the downhole processor determines the position of the drill string in the well borehole. In embodiments, the downhole processor uses historic or previously obtained survey data and/or positions of the drill string in the well borehole to determine the present position of the drill string in the well borehole.

To obtain survey data, the downhole processor receives sensor data from orientation sensors, such as orientation sensors 110. In embodiments, the survey data includes multiple axis survey data, such as six-axis survey data including three axes of accelerometer data (AX, AY, and AZ) and three axes of magnetometer data (MX, MY, and MZ). In embodiments, the survey data includes calculated survey values, such as inclination and azimuth, determined by the downhole processor from the six-axis survey data. In embodiments, the downhole processor determines and uses survey values, such as the total gravity, the total magnetic field, the dip angle, the inclination, and the azimuth to determine the position of the drill string in the well borehole. In embodiments, the downhole processor accesses and retrieves historic or previously obtained survey data and/or positions of the drill string in the well borehole from memory to determine the present position of the drill string in the well borehole.

Also, in embodiments, the distance drilled is determined from the number and length of drill pipes used in drilling operations, and in embodiments, the distance drilled is communicated to the downhole processor from the surface, such as from the uphole processor.

At 402, the method includes determining, by the downhole processor, whether the position of the drill string in the well borehole is on the drill plan or off the drill plan. Processing continues at 404 if the position of the drill string in the well borehole is off the drill plan and processing continues at 406 if the drill string in the well borehole is on the drill plan.

The downhole processor has access to the drill plan and compares the determined position of the drill string in the well borehole to the expected position of the drill string in the drill plan. In embodiments, the expected position of the drill string in the drill plan is based on the drill plan and the distance drilled. In embodiments, the drill plan is stored in memory and the downhole processor accesses the memory and retrieves the drill plan. In embodiments, the downhole processor receives the drill plan from the surface, such as through communications with the uphole processor. In embodiments, the drill plan includes one or more well segments that define the contours of the finished well borehole. In embodiments, the drill plan includes the first vertical segment A, the second curved segment B, and the third lateral segment C. In other embodiments, the drill plan includes only one or two segments, or the drill plan includes more than three segments.

In embodiments, the downhole processor determines which well segment the drill string is in and whether the position of the drill string in the well borehole is on the drill plan or off the drill plan. In embodiments, the downhole processor compares one or more of the calculated inclination and azimuth values to one or more threshold values to determine if the drill string in the well borehole is on the drill plan or off the drill plan.

At 404, the method includes transmitting, by the downhole processor, non-compressed survey data or signals. In embodiments, transmitting non-compressed survey data includes transmitting six-axis survey data to the surface, such that inclination and azimuth can be calculated on the surface, which allows for corrections that cannot be applied by the downhole processor. In embodiments, transmitting non-compressed survey data includes transmitting calculated survey values, including inclination and azimuth values. In embodiments, transmitting non-compressed survey data includes transmitting calculated survey values, such as the total gravity, the total magnetic field, the dip angle, the inclination, and/or the azimuth. In embodiments, transmitting non-compressed survey data includes encoding the survey data, such as by one or more of pulse width modulation and pulse position modulation, and transmitting the encoded (modulated) survey data.

At 408, the method includes receiving, such as by the uphole processor, the non-compressed survey data. In embodiments, the method includes receiving encoded non-compressed survey data and the method further includes decoding the encoded non-compressed survey data to obtain the non-compressed survey data. In embodiments, the method includes receiving non-compressed six-axis survey data and determining inclination and azimuth at the surface, which allows for corrections that cannot be applied by the downhole processor. In embodiments, the method includes receiving non-compressed calculated survey data, including inclination and azimuth. In embodiments, the method includes displaying the non-compressed survey data.

At 406, the method includes compressing, by the downhole processor, the survey data. In embodiments, compressing the survey data includes compressing the survey data according to the well drill plan optimization compression scheme. In embodiments, compressing the survey data includes compressing the survey data according to the expected optimization compression scheme described above. In embodiments, compressing the survey data includes compressing deltas for the total gravity, the total magnetic field, the dip angle, and one or more of the inclination and the azimuth. In embodiments, compressing the survey data includes compressing deltas for the total gravity, the total magnetic field, and the dip angle, and providing one or more of non-compressed inclination data and azimuth data.

At 410, the method includes transmitting, by the downhole processor, the compressed survey data or signals. In embodiments, transmitting the compressed survey data includes transmitting survey data that has been compressed by the downhole processor using the well drill plan optimization compression scheme. In embodiments, transmitting compressed survey data includes transmitting survey data that has been compressed using the expected optimization compression scheme described above and, in embodiments, including at least one of compressed azimuth survey data and non-compressed azimuth survey data. In embodiments, transmitting compressed survey data includes encoding the compressed survey data, such as by one or more of pulse width modulation and pulse position modulation, and transmitting the encoded (modulated) compressed survey data.

At 412, the method includes receiving, such as by the uphole processor, the compressed survey data. In embodiments, the method includes receiving encoded compressed survey data and decoding the encoded compressed survey data to obtain the compressed survey data. In embodiments, the method includes receiving the compressed survey data or encoded compressed survey data and providing non-compressed survey data from the compressed survey data. In embodiments, the method includes receiving compressed six-axis survey data and determining inclination and azimuth at the surface, which allows for corrections that cannot be applied by the downhole processor. In embodiments, the method includes receiving compressed calculated survey data and determining non-compressed survey data from the compressed survey data. In embodiments, the method includes displaying the compressed/non-compressed survey data.

In embodiments, the downhole processor transmits a single bit to the uphole processor to indicate whether the survey data is compressed or non-compressed survey data. In embodiments, the uphole processor uses the number of bits received by the uphole processor to determine whether the survey data is compressed or non-compressed.

In embodiments, the downhole processor transmits the compressed/non-compressed survey data based on the distance drilled since the last previous transmission. In embodiments, the downhole processor transmits the compressed/non-compressed survey data based on the time that has expired since the last previous transmission of data.

Also, in embodiments, the method includes transmitting, by the downhole processor, delta compressed survey data, such as partial survey data, between transmissions of the compressed/non-compressed survey data. The downhole processor obtains one or more measured survey values and transmits deltas, i.e., changes, between the measured survey values and the last previously transmitted survey values. The uphole processor receives the deltas and determines survey values from the deltas. This continuous delta compression scheme is useful for transmitting survey measurements that do not change much over time. In embodiments, the downhole processor transmits the deltas during drilling operations. In embodiments, the downhole processor transmits the deltas as the drill string moves through the well borehole. In embodiments, the downhole processor transmits deltas using the continuous delta compression scheme between surveys, such as between taking full six-axis surveys. In embodiments, the continuous delta compression scheme is applicable for transmitting continuous inclination and/or continuous azimuth measurements.

The systems and methods described above can be used to transmit survey data and other suitable data. In some embodiments, the systems and methods described above can be used to transmit sliding data obtained while sliding. In some embodiments, the systems and methods described above can be used to transmit rotating data obtained while rotating the drill string.

Various modifications and additions can be made to the exemplary embodiments discussed without departing from the scope of the present disclosure. For example, while the embodiments described above refer to features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

We claim:

1. A measurement while drilling system, comprising:

a first module situated at a distal end of a drill string and including:

a downhole processor configured to determine that the drill string is one of on a drill plan and off the drill plan; and a downhole communication module communicatively coupled to the downhole processor to transmit signals; and a second module situated at a proximal end of the drill string and including an uphole communication module communicatively coupled to an uphole processor, wherein the uphole communication module is configured to receive the signals transmitted from the downhole communication module, wherein the downhole processor is configured to transmit downhole non-compressed data if the drill string is off the drill plan and downhole compressed data if the drill string is on the drill plan; and further wherein, when the uphole communication module receives the downhole compressed data, the uphole processor determines uphole non-compressed data from the downhole compressed data and the drill plan.

2. The measurement while drilling system of claim 1, wherein the downhole processor is configured to determine if an orientation of the drill string is one of on the drill plan and off the drill plan.

3. The measurement while drilling system of claim 1, wherein the downhole processor is configured to determine if a position of the drill string in a borehole is one of on the drill plan and off the drill plan.

4. The measurement while drilling system of claim 1, wherein the downhole processor is configured to obtain at least one of a six-axis survey and a calculated survey of the drill string to determine that the drill string is one of on the drill plan and off the drill plan.

5. The measurement while drilling system of claim 1, wherein the downhole processor is configured to transmit delta compressed signals between surveys of the drill string.

6. The measurement while drilling system of claim 1, wherein the downhole processor is at least one of preprogrammed with the drill plan and configured to receive drill plan information.

7. The measurement while drilling system of claim 1, wherein the downhole compressed data includes compressed delta data.

8. The measurement while drilling system of claim 1, wherein the downhole processor is configured to transmit at least one bit that indicates that the drill string is on the drill plan or off the drill plan.

9. The measurement while drilling system of claim 1, wherein the downhole processor is configured to obtain at least one survey value of the drill string and compare the at least one survey value to at least one threshold value to determine that the drill string is one of on the drill plan and off the drill plan.

10. The measurement while drilling system of claim 1, wherein the downhole processor is configured to transmit at least one of survey data, sliding data, and rotating data.

11. A measurement while drilling system, comprising:

a first module situated at a distal end of a drill string and including:

a downhole processor; and a downhole communication module communicatively coupled to the downhole processor and configured to transmit data from the downhole processor; and a second module situated at a proximal end of the drill string and including an uphole communication module having an uphole processor, wherein the uphole communication module is configured to receive the data transmitted by the downhole communication module, wherein the downhole processor is configured to determine a well segment of a drill plan in which the drill string is located based on an orientation of the drill string and to transmit compressed data that corresponds to the well segment; and further wherein the uphole processor receives the compressed data and determines non-compressed data from the compressed data, based on the drill plan.

12. The measurement while drilling system of claim 11, wherein the drill plan includes three well segments.

13. The measurement while drilling system of claim 11, wherein the downhole processor is configured to obtain at least one of a six-axis survey and a calculated survey of the drill string to determine which well segment of the drill plan the drill string is in.

14. A method of controlling well path trajectory comprising:

determining, by a downhole processor, that the drill string is one of on a drill plan and off the drill plan;

transmitting, by the downhole processor, downhole non-compressed data if the drill string is off the drill plan and downhole compressed data if the drill string is on the drill plan; and receiving, by an uphole processor, the downhole non-compressed data and the downhole compressed data;

determining uphole non-compressed data from the downhole compressed data, based on the drill plan.

15. The method of claim 14, comprising:

obtaining, by the downhole processor, at least one of a six-axis survey and a calculated survey of the drill string to determine that the drill string is one of on the drill plan and off the drill plan.

16. The method of claim 14, comprising:

transmitting delta compressed signals between surveys of the drill string.

17. The method of claim 14, comprising:

transmitting at least one bit that indicates that the drill string is one of on the drill plan and off the drill plan.

18. The method of claim 14, comprising;

obtaining at least one orientation value; and comparing the at least one orientation value to one or more threshold values to determine that the drill string is in a well segment of a well plan and to determine that the drill string is one of on the drill plan and off the drill plan.

19. The method of claim 14, wherein determining, by the downhole processor, that the drill string is one of on the drill plan and off the drill plan comprises receiving, by the downhole processor, at least one of well string length and drill plan information.

20. The method of claim 14, wherein determining, by the downhole processor, that the drill string is one of on the drill plan and off the drill plan comprises comparing, by the downhole processor, an inclination value to an inclination threshold value.

* * * * *